US011187231B2

(12) United States Patent
Takashi et al.

(10) Patent No.: US 11,187,231 B2
(45) Date of Patent: Nov. 30, 2021

(54) SCROLL COMPRESSOR

(71) Applicant: Samsung Electronics Co., Ltd, Suwon-si (KR)

(72) Inventors: Uekawa Takashi, Kanagawa (JP); Yang Hee Cho, Kanagawa (JP)

(73) Assignee: Samsung Electronic Co., Ltd., Suwon-si (KR)

( * ) Notice: Subject to any disclaimer, the term of this patent is extended or adjusted under 35 U.S.C. 154(b) by 136 days.

(21) Appl. No.: 16/588,716

(22) Filed: Sep. 30, 2019

(65) Prior Publication Data

US 2020/0102954 A1 Apr. 2, 2020

(30) Foreign Application Priority Data

Sep. 28, 2018 (JP) ..... JP2018-183776
Jan. 8, 2019 (JP) ..... JP2019-001138
Sep. 10, 2019 (KR) ..... 10-2019-0112190

(51) Int. Cl.
*F04C 18/02* (2006.01)
*F04C 27/00* (2006.01)
*F04C 29/00* (2006.01)
*F04C 23/00* (2006.01)

(52) U.S. Cl.
CPC ..... *F04C 18/0215* (2013.01); *F04C 23/008* (2013.01); *F04C 27/005* (2013.01); *F04C 29/0021* (2013.01); *F04C 2240/50* (2013.01)

(58) Field of Classification Search
CPC ..... F04C 18/0215; F04C 27/005; F04C 29/0021; F04C 2240/30; F04C 2240/50
See application file for complete search history.

(56) References Cited

U.S. PATENT DOCUMENTS 5,622,488 A 4/1997 Tojo et al.
5,660,539 A * 8/1997 Matsunaga ..... F04C 27/005 184/6.18

(Continued)

FOREIGN PATENT DOCUMENTS

EP 1002953 B1 12/2004
JP H0893661 A 4/1996

(Continued)

OTHER PUBLICATIONS

International Search Report dated Jan. 17, 2020 in connection with International Patent Application No. PCT/KR2019/012532, 3 pages.

(Continued)

*Primary Examiner* — Mark A Laurenzi
*Assistant Examiner* — Xiaoting Hu

(57) ABSTRACT

Disclosed herein is a scroll compressor capable of optimizing a position where a load is applied from a support member to an orbiting scroll. The scroll compressor includes a fixed scroll fixed to an inside of a body, an orbiting scroll configured to orbit in engagement with the fixed scroll, a rotary shaft configured to allow the orbiting scroll to orbit, a holding member configured to hold the fixed scroll from a side opposite to the orbiting scroll, and a support member arranged between the rotary shaft and the holding member to support the orbiting scroll by a load applied to a position away from a center of the orbiting scroll.

16 Claims, 18 Drawing Sheets

(56) References Cited

U.S. PATENT DOCUMENTS

| | | | | |
|---|---|---|---|---|
| 6,135,739 | A * | 10/2000 | Ogawa | F04C 23/008 418/14 |
| 9,726,177 | B2 | 8/2017 | Choi et al. | |
| 2002/0102175 | A1* | 8/2002 | Nishiki | F04C 23/008 418/55.5 |
| 2003/0031576 | A1* | 2/2003 | Fushiki | F04C 23/008 418/55.5 |
| 2003/0077194 | A1* | 4/2003 | Ikeda | F04C 27/005 418/55.6 |
| 2003/0082064 | A1* | 5/2003 | Sano | F04C 29/0021 418/55.1 |
| 2003/0086798 | A1* | 5/2003 | Tani | F04C 23/008 417/366 |
| 2006/0140803 | A1 | 6/2006 | Kim | |
| 2015/0152864 | A1* | 6/2015 | Nagaoka | F04C 23/008 417/410.5 |
| 2015/0285249 | A1* | 10/2015 | Nagaoka | F04C 18/0215 417/410.5 |
| 2015/0316054 | A1 | 11/2015 | Jin et al. | |
| 2015/0354572 | A1 | 12/2015 | Yokoyama et al. | |
| 2018/0017055 | A1* | 1/2018 | Nagaoka | F04C 18/0253 |
| 2019/0186489 | A1* | 6/2019 | Yosuke | F04C 18/02 |

FOREIGN PATENT DOCUMENTS

| | | | | |
|---|---|---|---|---|
| JP | 2000-337276 | A | 12/2000 | |
| JP | 5641978 | B2 | 12/2014 | |
| KR | 0115531 | Y1 | 4/1998 | |
| KR | 10-2016-0018166 | A | 2/2016 | |
| WO | WO-2018042854 | A1 * | 3/2018 | F04C 23/008 |

OTHER PUBLICATIONS

Supplementary European Search Report dated Aug. 20, 2021 in connection with European Patent Application No. 19 86 4598, 10 pages.

* cited by examiner

SCROLL COMPRESSOR

CROSS-REFERENCE TO RELATED APPLICATIONS

This application is based on and claims priority under 35 U.S.C. 119 to Korean Patent Application No. 10-2019-0112190 filed on Sep. 10, 2019 in the Korean Intellectual Property Office, which claims the benefit of Japanese Patent Application No. 2018-183776 filed on Sep. 28, 2018, and Japanese Patent Application No. No. 2019-001138 filed on Jan. 18, 2019 in the Japanese Patent Office, the disclosures of which are herein incorporated by reference in their entirety.

BACKGROUND

1. Field

The disclosure relates to a scroll compressor.

2. Description of Related Art

A scroll compressor is configured as follows. A sealed container is maintained at high pressure. In the sealed container, a fixed scroll and an orbiting scroll configured in such a way that spiral shaped wraps thereof are engaged with each other to form a compression chamber on a support plate, a main shaft configured to drive the orbiting scroll by inserting an eccentric shaft portion into a boss portion provided on a side opposite to the spiral shaped wrap of the orbiting scroll, a compliant frame configured to support the orbiting scroll in an axial direction while radially supporting the main shaft, which drives the orbiting scroll, on a main shaft portion provided in the main shaft, and a guide frame configured to support the compliant frame in a radial direction so as to be fixed to the sealed container are provided. Therefore, the orbiting scroll is moveable in the axial direction by the sliding movement of the compliant frame about the guide frame in the axial direction (refer to Patent document).

RELATED ART DOCUMENT

Patent Document

Japanese Patent 5641978 (2014 Nov. 7)

SUMMARY

In a state in which a support member, which is arranged between a rotary shaft allowing an orbiting scroll to orbit and a holding member holding a fixed scroll, supports the orbiting scroll, when a configuration in which the orbiting scroll is movable in only an axial direction by a sliding movement of the support member about the holding member in the axial direction is employed, it is difficult to optimize a position where a load is applied from the support member to the orbiting scroll.

Therefore, it is an aspect of the disclosure to provide a scroll compressor capable of optimizing a position where a load is applied from a support member to an orbiting scroll.

Additional aspects of the disclosure will be set forth in part in the description which follows and, in part, will be obvious from the description, or may be learned by practice of the disclosure.

In accordance with an aspect of the disclosure, a scroll compressor includes a fixed scroll fixed to a body, an orbiting scroll configured to orbit in engagement with the fixed scroll, a rotary shaft configured to allow the orbiting scroll to orbit, a holding member configured to hold the fixed scroll from a side opposite to the orbiting scroll, and a support member arranged between the rotary shaft and the holding member to support the orbiting scroll by a load applied to a position away from the center of the orbiting scroll.

The support member may be movable in one direction about the holding member.

The support member may be movable in a direction along the rotary shaft and further movable in a rotational direction about a virtual axis approximately perpendicular to the rotary shaft.

The support member may be movable in a direction opposite: to a moment generated in the orbiting scroll among rotational directions about the virtual axis.

The support member may be movable in a rotational direction opposite to a moment generated in the orbiting scroll by receiving a reaction force, which is in the holding member against a load that the orbiting scroll receives, from a certain position in the orbiting scroll side rather than a position receiving a load in the rotary shaft. The certain position may be between an end face of a rotary shaft bearing of the support member in the orbiting scroll side and a surface on which a plate of the orbiting scroll is engaged with the fixed scroll.

The support member may be movable in a rotational direction opposite to a moment generated in the orbiting scroll because as for a position receiving a load about the rotary shaft, the smallest gap with the holding member in the same side as the orbiting scroll is less than the smallest gap with the holding member in the opposite side to the orbiting scroll. The certain position may be between an end face of a rotary shaft bearing of the support member in the orbiting scroll side and a surface on which a plate of the orbiting scroll is engaged with the fixed scroll.

The support member may be movable in a rotational direction opposite to a moment generated in the orbiting scroll by being in contact with a protrusion provided on the holding member.

A portion of the support member may have a shape that is elastically deformable upon being in contact with a surface on which a plate of the orbiting scroll is engaged with the fixed scroll due to the inclination of the support member.

The scroll compressor may further include an Oldham ring configured to prevent a pivot of the orbiting scroll, and the Oldham ring may be coupled to the orbiting scroll and the support member, the orbiting scroll and the holding member, or the orbiting scroll and the fixed scroll.

The scroll compressor may further include a seal mechanism configured to form an internal space between at least the holding member and the support member by sealing at least a portion of the gap between the holding member and the support member.

The holding member may be provided with a holding member internal passage configured to introduce a refrigerant, which is introduced from a compression chamber, which is formed in such a way that the orbiting scroll orbits by being engaged with the fixed scroll, into an inner space.

The fixed scroll may be provided with a fixed scroll internal passage configured to move a refrigerant from the compression chamber and introduce the refrigerant into the holding member internal passage.

The fixed scroll may be provided with a fixed scroll internal passage configured to move a refrigerant from the compression chamber and introduce the refrigerant into the holding member internal passage, and the orbiting scroll may be provided with an orbiting scroll internal passage configured to move a refrigerant from the compression chamber and introduce the refrigerant into the fixed scroll internal passage. In this case, the fixed scroll internal passage may be in communication with the orbiting scroll internal passage for at least a part of a period in which the orbiting scroll orbits. The fixed scroll internal passage may include an inlet on a track of an outlet of orbiting scroll internal passage at the orbit of the orbiting scroll, and an inlet connected to a groove portion covering the entire of the track of an outlet of orbiting scroll internal passage at the orbit of the orbiting scroll.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter embodiments of the disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

According to embodiments, a scroll compressor is provided with a fixed scroll, an orbiting scroll configured to orbit in engagement with the fixed scroll, a rotary shaft configured to allow the orbiting scroll to orbit, a holding member configured to hold the fixed scroll on the opposite side of the orbiting scroll, and a support member arranged between the rotary shaft and the holding member. The support member supports the orbiting scroll by a load applied to a position away from the center of the orbiting scroll. That is, the support member may be provided to support the orbiting scroll at a position away from the center of the orbiting scroll. As a specific configuration for supporting the orbiting scroll by a load applied to a position in which the support member is displaced from the center of the orbiting scroll, some configurations may be considered. Hereinafter the configurations will be described as embodiments.

Figure 1:
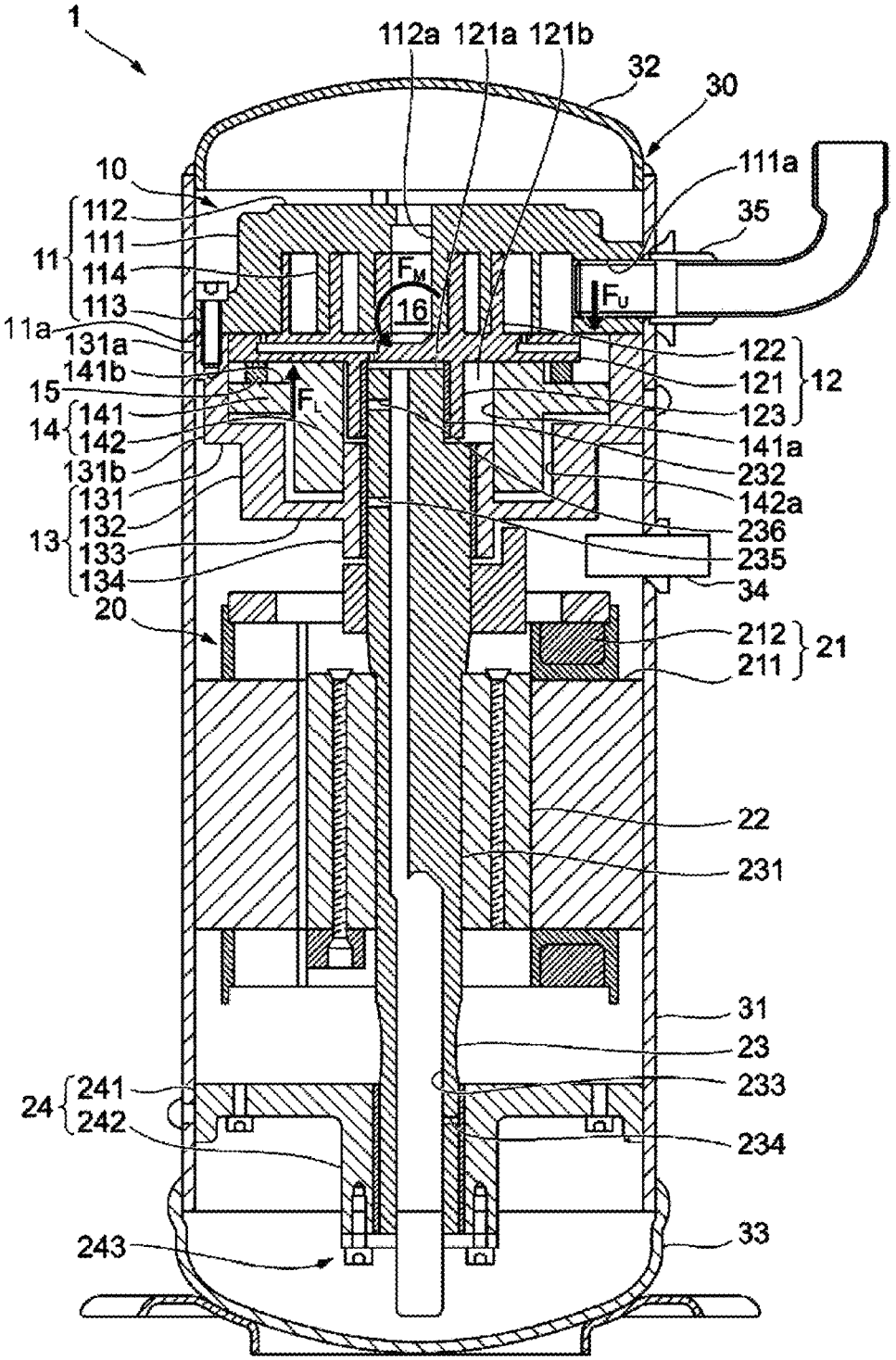
FIG. 1 illustrates an axial cross-sectional view of a scroll compressor according to an embodiment of the disclosure.

FIG. 1 illustrates an axial cross-sectional view of a scroll compressor 1 according to an embodiment of the disclosure.

The scroll compressor 1 is a compressor widely used for an air conditioner, a freezer, and a pump. FIG. 1 is a longitudinal sectional view of a hermetic scroll compressor used in a refrigerant circuit of an air conditioner.

The scroll compressor 1 includes a compression portion 10 configured to compress a refrigerant, a drive motor 20 configured to drive the compression portion 10, and a casing 30 corresponding to a body configured to receive the compression portion 10 and the drive motor 20. According to an embodiment, the scroll compressor 1 is a vertical scroll compressor in which an axial direction of a rotary shaft 23, which will be described later, of the drive motor 20 is coincident with the gravity direction. Hereinafter the axial direction of the rotary shaft 23 will be referred to as "vertical direction", and based on FIG. 1, the up side may be referred to as "upper side" and the down side may be referred to as "lower side". Although the vertical scroll compressor is described as an example, but an embodiment of the disclosure will be applicable to a horizontal scroll compressor.

First, the compression portion 10 will be described.

The compression portion 10 includes a fixed scroll 11 fixed to the casing 30, an orbiting scroll 12 orbiting by being engaged with the fixed scroll 11, a main frame 13 fixed to the casing 30 and configured to support the fixed scroll 11, a sub frame 14 arranged in a space surrounded by the orbiting scroll and the main frame 13 and configured to support the orbiting scroll 12, and an Oldham ring 15 configured to allow the orbiting scroll 12 to orbit without pivoting the orbiting scroll 12.

The fixed scroll 11 may include a fixed scroll body and a fixed wrap 114 protruding from the fixed scroll body. The fixed wrap 114 may protrude downward from the fixed scroll body.

The fixed scroll body may include a cylindrical body portion 111, a plate 112 configured to cover an opening in an upper side of the body portion 111, and a protrusion 113 extending from a lower end of the body portion 111 in radially outward direction. The fixed wrap 114 may protrude downward from a lower portion of the plate 112 and have a spiral shape when viewed from the bottom.

The fixed scroll 11 may be formed of cast iron such as gray cast iron FC 250.

The body portion 111 may be provided with a through hole 111*a* in the radial direction. The though hole 111*a* may serve as a suction port configured to suction the refrigerant into a space surrounded by the body portion 111, the plate 112 and the orbiting scroll 12.

A through hole 112*a* in the vertical direction is formed at the center of the plate 112. The through hole 112*a* may serve as a discharge port configured to discharge the refrigerant from the space surrounded by the plate 112, the fixed wrap 114 and the orbiting scroll 12.

The fixed scroll 11 constructed as described above is fixed to the main frame 13 by a positioning means such as a bolt or a positioning pin passed through the through hole in the vertical direction formed in the protrusion 113.

The orbiting scroll 12 may include an orbiting scroll body and an orbiting wrap 122 protruding from the orbiting scroll body to form a compression chamber 16 by being engaged with the fixed wrap 114 of the fixed scroll 11. The orbiting wrap 122 may protrude upward from the orbiting scroll body.

The orbiting scroll 12 may perform an orbital movement by being coupled the rotary shaft 23.

The orbiting scroll body may include a plate 121 having a disk shape, and a cylindrical body portion 123 protruding downward from a lower end of the plate 121. The orbiting wrap 122 may protrude upward from an upper end of the plate 121 and have a spiral shape when viewed from the top.

The orbiting scroll 12 may be formed of FC material or FCD material.

The orbiting wrap 122 of the orbiting scroll 12 may be engaged with the fixed wrap 114 of the fixed scroll 11. Further, the orbiting wrap 122 of the orbiting scroll 12 and the fixed wrap 114 of the fixed scroll 11 may be placed in a space formed by the body portion 111 and the plate 112 of the fixed scroll 11, and of the plate 121 so as to form the compression chamber 16. Because the orbiting wrap 122 is circularly moved about the fixed wrap 114 that is fixed, a volume of the compression chamber 16 is reduced and the refrigerant of the compression chamber 16 is compressed. In other words, as an internal space between the fixed wrap 114 and the orbiting wrap 122 is reduced toward a center of rotation, the refrigerant is compressed.

An eccentric shaft 232 of the rotary shaft 23, which is described later, is inserted into the body portion 123 through a sliding bearing. As described above, the body portion 123 functions as a bearing of the eccentric shaft 232.

The main frame 13 is an example of a holding member configured to hold the fixed scroll 11. The main frame 13 may include a cylindrical first body portion 131, a cylindrical second body portion 132 protruding downward from the radially inner side of the lower end of the first body portion 131, a cylindrical third body portion 133 protruding radially inwardly from the lower end of the second body portion 132, and a cylindrical fourth body portion 134 protruding upward and downward from the inner end of the third body portion 133. An outer circumferential surface of the first body portion 131 of the main frame 13 is fixed to a central casing 31 of the casing 30, which is described later. In addition, while a journal bearing is interposed therebetween, the rotary shaft 23 of the drive motor 20 described later is inserted into the inside of the fourth body portion 134. As mentioned above, the main frame 13 also functions as a bearing for rotatably supporting the rotary shaft 23.

On an outer circumferential portion of the first body portion 131, a protrusion 131*a* protruding upward from the upper end surface is installed. A female screw is formed in the protrusion 131*a*, and a bolt, which passed through the through hole formed in the protrusion 113 of the fixed scroll 11, is engaged with the female screw. Therefore, the fixed scroll 11 is fixed to the main frame 13.

On the outer circumferential portion of the first body portion 131, a groove 131*b* elongating in the vertical direction may be provided. That is, in the first body portion 131, the groove 131*b* extending in the vertical direction from the center to the lower portion of the outer circumferential portion may be formed. In the first body portion 131, a portion where the groove 131*b* is formed may be spaced apart from the central casing 31.

The rotary shaft 23 is fitted in the inner circumference of the fourth body portion 134 with the journal bearing interposed therebetween and thus the fourth body portion 134 functions as a bearing for rotatably supporting the rotary shaft 23.

The main frame 13 may further include a fixed scroll support surface 11*a* configured to support the fixed scroll 11. The fixed scroll support surface 11*a* may be formed on the protrusion 131*a*.

The sub-frame 14 is an example of a support member for supporting the orbiting scroll 12. A gap may be formed between the main frame 13 and the sub frame 14 such that the sub-frame 14 is movable with respect to the main frame 13. In other words, the sub-frame 14 may be arranged inside the main frame 13 to be spaced apart from the main frame 13.

The sub-frame 14 may include a cylindrical first body portion 141 and a cylindrical second body portion 142 protruding downward from a lower end surface of the first body portion 141. Between an outer circumferential surface of the first body portion 141 of the sub-frame 14 and an inner circumferential surface of the first body portion 131 of the main frame 13, and between an inner circumferential surface of the second body portion 142 of the sub-frame 14 and an outer circumferential surface of the fourth body portion 134 of the main frame 13, the sub-frame 14 may be arranged in a space surrounded by the orbiting scroll 12 and the main frame 13 with a gap in which the sub-frame 14 is movable about the main frame 13 only in the axial direction of the rotary shaft 23.

In addition, in a portion formed by the fourth body portion 134 of the main frame 13 and the first body portion 141 of the sub-frame 14, and a portion formed by the first body portion 131 of the main frame 13 and the first body portion 141 of the sub-frame 14, a first groove 141*a* and a second groove 141*b* recessed downward from an upper end surface are formed. In the radial direction, the first groove 141*a* is formed in the center portion, and the second groove 141*b* is formed between the first groove 141*a* and the protrusion 131*a*. Further, the body portion 123 of the orbiting scroll 12 is inserted into the first groove 141*a*. In the second groove 141*b*, the Oldham ring 15 preventing a pivot of the orbiting scroll 12 is arranged between the main frame 13 and the orbiting scroll 12.

In addition, in the above-described compression portion 10, a discharge passage discharging refrigerant compressed in the compression chamber 16 is formed. As for the discharge passage is configured to discharge the high-pressure refrigerant, one end thereof is connected to the through hole 112*a* of the plate 112, which is configured to discharge the high-pressure refrigerant from the space surrounded by the fixed scroll 11 and the orbiting scroll 12, and the other end thereof is connected to a space lower than the main frame 13 in the casing 30 and further connected to a chamber 121*a*. As for a discharge passage configured to discharge an intermediate pressure refrigerant, one end thereof is connected to a discharge port, which is configured to discharge the intermediate-pressure refrigerant from a space surrounded by the fixed scroll 11 and the orbiting scroll 12, and the other end thereof is connected to chambers 121*b* and 142*a*.

Next, the drive motor 20 will be described.

The drive motor 20 is fixed to the casing 30 under the compression portion 10. The drive motor 20 may include a stator 21 constituting a stator, a rotor 22 constituting a rotor, the rotary shaft 23 supporting the rotor 22 and rotating with respect to the casing 30, and a support member 24 rotatably supporting the rotary shaft 23.

The stator 21 may include a stator body 211 and a coil 212 wound around the stator body 211. The stator body 211 is a laminated body in which a plurality of electrical steel sheets is laminated, and has an approximately cylindrical shape. A diameter of an outer circumferential surface of the stator body 211 is formed greater than a diameter of an inner circumferential surface of the central casing 31 of the casing 30 which is described later. The stator body 211 (stator 21) is forcedly inserted to the central casing 31. A method for inserting the stator body 211 to the central casing 31 may employ shrink fitting or press fitting method Further, the stator body 211 has a plurality of teeth in the circumferential direction on the inner side portion facing the outer circumference of the rotor 22. The coil 212 is arranged in a slot formed between adjacent tooth. In the stator 21 according to an embodiment, a concentrated winding, in which the coil 212 is inserted into a slot placed between a plurality of adjacent tooth, is described as an example of the coil 212.

The rotor 22 is a laminated body in which a plurality of electrical steel sheets having a ring shape is laminated, and has an approximately cylindrical shape. A diameter of an inner circumferential surface of the rotor 22 is formed less than the diameter of an outer circumferential surface of the rotary shaft 23. The rotor 22 is forcedly inserted to the rotary shaft 23. A method for inserting the rotor 22 to the rotary shaft 23 may employ the press fitting method. The rotor 22 is fixed to the rotary shaft 23 and rotates together with the rotary shaft 23. Further, a rotor in which one permanent magnet is embedded therein is described as an example of the rotor 22.

The diameter of the outer circumferential surface of the rotor 22 is less than the diameter of the inner circumferential surface of the stator body 211 of the stator 21 and a gap is formed between the rotor 22 and the stator 21.

The rotary shaft 23 may include a main shaft 231 to which the rotor 22 is fitted and coupled, and the eccentric shaft 232 provided on the upper portion of the main shaft 231 and having an axis eccentric from the axis of the main shaft 231.

The lower portion of the main shaft 231 is rotatably supported by the support member 24 and the upper portion of the main shaft 231 is rotatably supported by the main frame 13 of the compression portion 10. The eccentric shaft 232 is rotatably supported by the body portion 123 of the orbiting scroll 12.

The rotary shaft 23 is provided with a through hole 233 passing through the rotary shaft 23 in the axial direction. In the rotary shaft 23, a first communication hole 234 allowing the through hole 233 to communicate with the bearing of the support member 24, a second communication hole 235 allowing the through hole 233 to communicate with the bearing of the main frame 13, and a third communication hole 236 allowing the through hole 233 to communicate with the bearing of the body portion 123 are formed in the radial direction.

The support member 24 includes a cylindrical first body portion 241 and a cylindrical second body portion 242 protruding downward from the lower end of the first body portion 241. The support member 24 is fixed to the central casing 31 in such a way that an outer circumferential surface of the first body portion 241 faces an inner circumferential surface of the central casing 31 of the casing 30 which is described later. In addition, the rotary shaft 23 is inserted into the inside of the first body portion 241 and the second body portion 242 with a journal bearing interposed therebetween. As mentioned above, the support member 24 functions as a bearing for rotatably supporting the rotary shaft 23.

In addition, in the first body portion 241, a hole and a groove allowing an upper space than the first body portion 241 to communicate with a lower space than the first body portion 241 is formed.

A pump 243 pumping lubricant is mounted to the lower end of the second body portion 242 of the support member 24.

Next, the casing 30 will be described.

The casing 30 may include the central casing 31 arranged in the center in the vertical direction and having a cylindrical shape, an upper casing 32 covering an upper opening of the central casing 31, and a lower casing 33 covering a lower opening of the central casing 31. Further, the casing 30 may include a discharge portion 34 discharging the high pressure refrigerant compressed by the compression portion 10 to the outside of the casing 30, and a suction portion 35 suctioning the refrigerant from the outside of the casing 30.

The main frame 13 of the compression portion 10 and the stator 21 and the support member 24 of the drive motor 20 are fixed to the central casing 31 as described above. The discharge portion 34 and the suction portion 35 are provided by inserting a pipe into a through hole formed in the central casing 31. The suction portion 35 is installed at a position corresponding to the through the hole 111*a* formed in the body portion 111 of the fixed scroll 11. The suction portion 35 suctions the refrigerant from the outside of the casing 30 into the space surrounded by the fixed scroll 11 and the orbiting scroll 12.

The lower casing 33 is formed in a bowl shape and thus lubricant can be collected.

Next, the operation of the scroll compressor 1 will be described.

When the drive motor 20 of the scroll compressor 1 drives, the rotary shaft 23 rotates and the orbiting scroll 12 fitted in the eccentric shaft 232 of the rotary shaft 23 orbits about the fixed scroll 11. As the orbiting scroll 12 orbits about the fixed scroll 11, the low pressure refrigerant is suctioned from the outside of the casing 30 into the space surrounded by the fixed scroll 11 and the orbiting scroll 12 through the suction portion 35. The refrigerant is compressed in accordance with the volume change of the compression chamber 16. The high-pressure refrigerant in the compression chamber 16 is discharged to the lower side of the compression portion 10.

The high-pressure refrigerant discharged to the lower side of the compression portion 10 is discharged to the outside of the casing 30 through the discharge portion 34 provided in the casing 30. In the process of being discharged to the outside of the casing 30, the high-pressure refrigerant is distributed to the gap between the rotor 22 and the stator 21 and the gap between the stator 21 and the central casing 31. The high-pressure refrigerant discharged to the outside of the casing 30 is suctioned into the suction portion 35 again after each operation of condensation, expansion and evaporation in the refrigerant circuit.

On the other hand, the lubricant stored in the lower casing 33 of the casing 30 is pumped up by the pump 243 and raised through the through hole 233 formed in the rotary shaft 23. The raised lubricant is supplied to each bearing of the rotary shaft 23 through the first communication hole 234, the second communication hole 235 and the third communication hole 236 formed in the rotary shaft 23, or is supplied to a sliding member of the compression portion 10. The lubricant, which is supplied to the sliding member of the compression portion 10 or the lubricant supplied to the bearing of the rotary shaft 23 through the second communication hole 235 and the third communication hole 236, is returned to the lower casing 33 through the communication hole 131*e* and the groove 131*b* formed in the main frame 13, the gap between the rotor 22 and the stator 21, and the axial direction hole formed in the support member 24, and then stored in the lower portion of the casing 30. In this process and in the process in which the high-pressure refrigerant is distributed to the gap between the rotor 22 and the stator 21 before being discharged to the outside of the casing 30, the lubricant and the refrigerant flow into the low pressure side while cooling the drive motor 20. The lubricant, which has been distributed together with the high pressure refrigerant, is separated from the refrigerant and then stored in the lower portion of the casing 30.

As described above, in the scroll compressor 1 according to an embodiment, the sub-frame 14 supporting the orbiting scroll 12 is arranged in the space surrounded by the orbiting scroll 12 and the main frame 13.

Because the conventional scroll compressor is not provided with the sub-frame 14, a moment load applied to the orbiting scroll 12 from the refrigerant sucked by the suction portion 35 is offset by an upper thrust load in the fixed scroll 11 and a back pressure load of the orbiting scroll 12. However, in the orbiting scroll 12 according to an embodiment, a moment load $F_M$ applied to the orbiting scroll 12 from the refrigerant sucked by the suction portion 35 is offset by an upper thrust reaction force $F_U$ in the fixed scroll 11 and a lower surface thrust reaction force $F_L$ in the sub-frame 14.

In this case, because a distance from an operating point of the upper surface thrust reaction force $F_U$ to an operating point of the lower surface thrust reaction force $F_L$ becomes long, the lower surface thrust reaction force $F_L$ is allowed to be smaller than a back surface load of a general scroll compressor. In addition, the upper surface thrust reaction force $F_U$ is allowed to be small. Therefore, the scroll compressor 1 according to an embodiment improves the efficiency by reducing the friction loss between the fixed scroll 11 and the orbiting scroll 12, and improves the reliability by reducing the load on the upper surface and lower surface sliding portion of the plate 121 of the orbiting scroll 12.

Next, a modification of the scroll compressor 1 according to an embodiment will be described.

Figure 2:
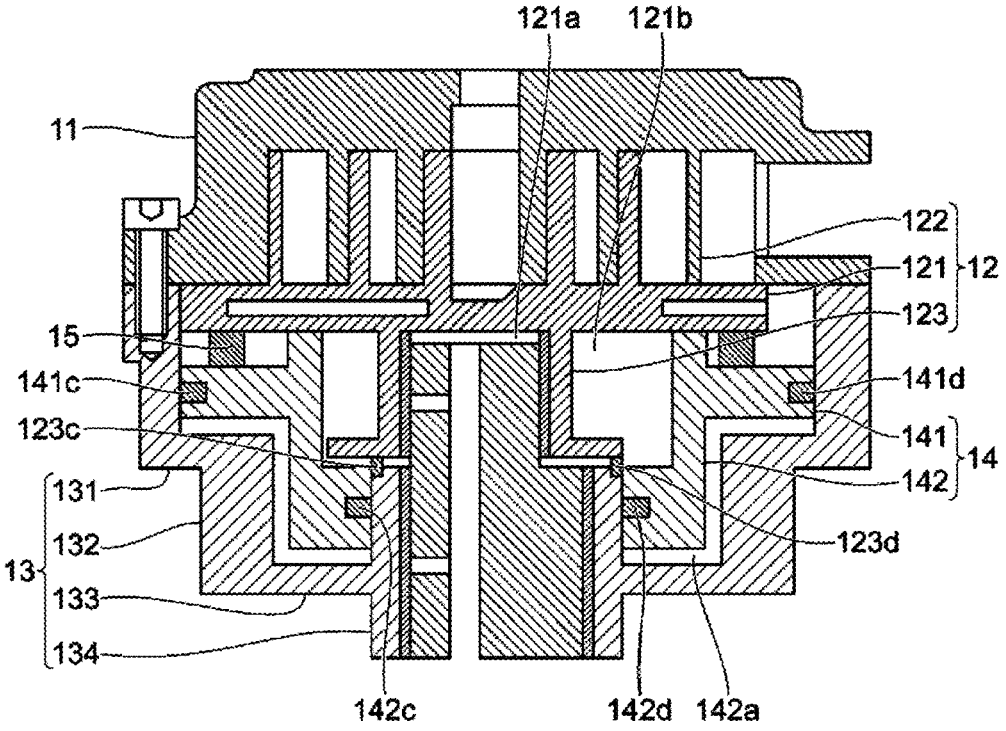
FIG. 2 illustrates an axial cross-sectional view of a compression portion and a rotary shaft of a modification of the scroll compressor according to an embodiment of the disclosure.

FIG. 2 is an axial cross-sectional view of a compression portion and a rotary shaft of a modification of the scroll compressor according to an embodiment of the disclosure.

According to a modification of the scroll compressor 1, a compression portion 10 may include a fixed scroll 11, an orbiting scroll 12, a main frame 13, a sub-frame 14, and an Oldham ring as illustrated in FIG. 1. Further, sealing members 123*c* and 123*d* configured to seal a gap between a fourth body portion 134 of the main frame 13 and a body portion 123 and the orbiting scroll 12 is provided in the body portion 123 of the orbiting scroll 12. That is, the sealing members 123*c* and 123*d* may be provided between the body portion 123 of the orbiting scroll 12 and the fourth body portion 134 of the main frame 13. According to the a modification, because the sealing members 123*c* and 123*d* are provided, it is possible to maintain the inside of a chamber 121*a* at a high pressure. Further, sealing members 141*c* and 141*d* as an example of a first sealing member is provided in a first body portion 141 of the sub-frame 14 to seal a gap between the first body portion 141 of the sub-frame 14 and the first body portion 131 of the main frame 13 (a first gap between the sub-frame 14 and the main frame 13), and at the same time, sealing members 142*c* and 142*d* as an example of a second sealing member is provided in a second body portion 142 of the sub-frame 14 to seal a gap between the second body portion 142 of the sub-frame 14 and the fourth body portion 134 of the main frame 13 (a second gap between the sub-frame 14 and the main frame 13). Therefore, according to a modification, by providing sealing members 141*c*, 141*d*, 142*c*, and 142*d*, it is possible to maintain the pressure of a chamber 142*a* at a certain intermediate pressure.

Further, according to a modification, the sealing members 141*c*, 141*d*, 142*c*, and 142*d* configured to seal the gap between the sub-frame 14 and the main frame 13 are provided. However, it should be understood that a sealing member configured to seal a gap between the sub-frame 14 and at least one member facing the sub-frame 14 is provided.

Figure 3:
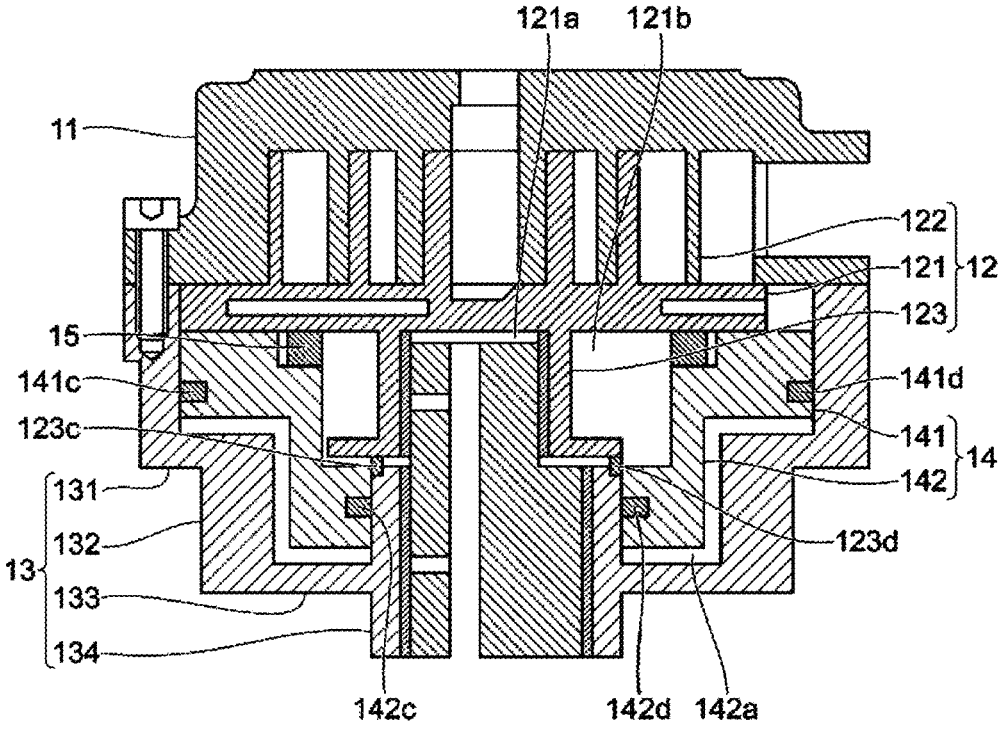
FIG. 3 illustrates an axial cross-sectional view of a compression portion and a rotary shaft of a modification of the scroll compressor according to an embodiment of the disclosure.

FIG. 3 illustrates an axial cross-sectional view of a compression portion and a rotary shaft of a modification of the scroll compressor according to an embodiment of the disclosure.

As for a compression portion 10 according to a modification of the scroll compressor 1, an outer diameter of a sub-frame 14 is increased in comparison with the compression portion 10 of the scroll compressor 1 according to a modification as illustrated in FIG. 2. Because an Oldham ring 15 is moved radially inward, a position where a first body portion 141 of the sub-frame 14 supports an orbiting scroll 12 is moved to radially outward. According to a modification, because a distance from an operating point of an upper thrust reaction force to an operating point of a lower thrust reaction force becomes increased, it is possible to decrease the upper thrust reaction force and the lower thrust reaction force.

Figure 4:
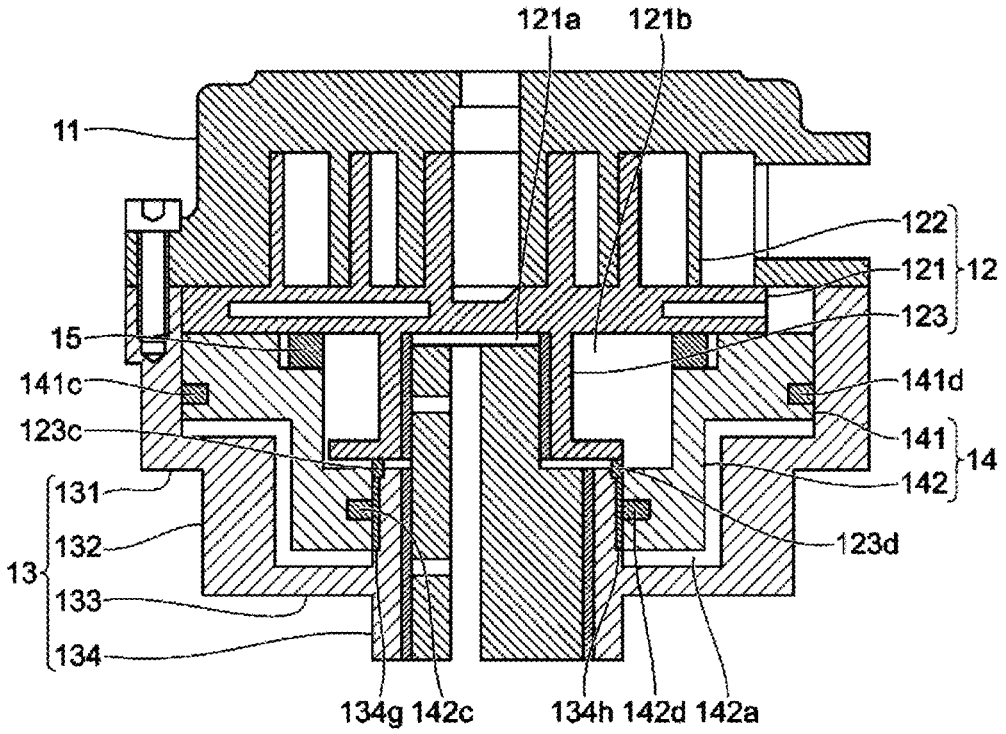
FIG. 4 illustrates an axial cross-sectional view of a compression portion and a rotary shaft of a modification of the scroll compressor according to an embodiment of the disclosure.

FIG. 4 illustrates an axial cross-sectional view of a compression portion and a rotary shaft of a modification of the scroll compressor according to an embodiment of the disclosure.

As for a compression portion 10 according to a modification of the scroll compressor 1, guide members 134*g* and 134*h* are provided in a fourth body portion 134 of a main frame 13 in comparison with the compression portion 10 of the scroll compressor 1 according to a modification as illustrated in FIG. 3. A rail may be described as an example of the guide member. Alternatively, a wheel rolling on a rail may be used and provided in a sub-frame 14. According to a modification, because the guide members 134*g* and 134*h* are provided in the fourth body 134 of the main frame 13, the sub-frame 14 may not be inclined and movable only in the axial direction of a rotary shaft 23.

Figure 5:
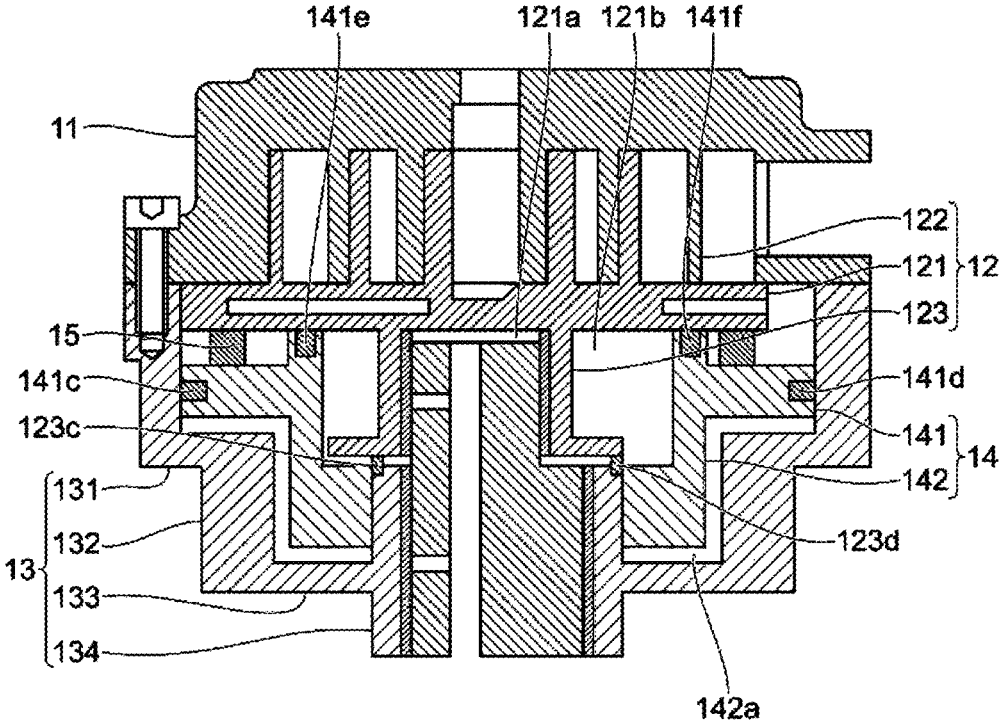
FIG. 5 illustrates an axial cross-sectional view of a compression portion and a rotary shaft of a modification of the scroll compressor according to an embodiment of the disclosure.

FIG. 5 illustrates an axial cross-sectional view of a compression portion and a rotary shaft of a modification of the scroll compressor according to an embodiment of the disclosure.

As for a compression portion 10 according to a modification of the scroll compressor 1, sealing members 141*e* and 141*f* configured to seal a gap between a first body portion 141 of a sub-frame 14 and a plate 121 of the orbiting scroll 12 is provided in the first body portion 141 of the sub-frame 14, instead of the sealing members 142*c* and 142*d* configured to seal the gap between the second body portion 142 of the sub-frame 14 and the fourth body portion 134 of the main frame 13 in the compression portion 10 of the scroll compressor 1 according to a modification as illustrated in FIG. 2. According to a modification, because the sealing members 141*c*, 141*d*, 141*e*, and 141*f* are provided, it is possible to maintain the pressure of the inside of a chamber 121*b* at a certain intermediate pressure identical to the pressure of the inside of a chamber 142*a*, by moving the refrigerant of the chamber 142*a* to the chamber 121*b*.

Further, in a modification, the sealing members 141*c* and 141*d* configured to seal the gap between the sub-frame 14 and the main frame 13 and the sealing members 141*e* and 141*f* configured to seal the gap between the sub-frame 14 and the orbiting scroll 12 are provided. However, it should be understood that a sealing member configured to seal a gap between the sub-frame 14 and at least one member facing the sub-frame 14 is provided.

As mentioned above, according to an embodiment, the sub-frame 14 configured to support the orbiting scroll 12 is provided in a space surrounded by the orbiting scroll 12, the rotary shaft 23 and the main frame 13 to be movable only in the axial direction of the rotary shaft 23 about the main frame 13. Accordingly, the pressure applied to the orbiting scroll 12 from the sub-frame 14 may be equalized regardless of the place, and the thrust load for stabilizing the orbiting scroll 12 may be reduced, thereby improving the efficiency and reliability of the scroll compressor 1.

In addition, in an embodiment, the sub-frame 14 is configured to be movable only in the direction along the rotary shaft 23 about the main frame 13. However, it does not mean that the sub-frame 14 does not move at all except the movement in the direction along the rotation axis 23 about the main frame 13. In addition to movement in the direction of the rotary shaft 23, when a rotation about the axis perpendicular to the rotary shaft 23 is not allowed among a rotation about the rotary shaft 23, a movement in a direction along an axis perpendicular to the rotary shaft 23, and a rotation about the axis perpendicular to the rotary shaft 23 other movements or rotations may be allowed. Further, it should be understood that the sub-frame 14 may be movable in a direction along the rotary shaft 23 about the main frame 13. Further, the sub-frame 14 may be movable in one direction about the main frame 13

Figure 6:
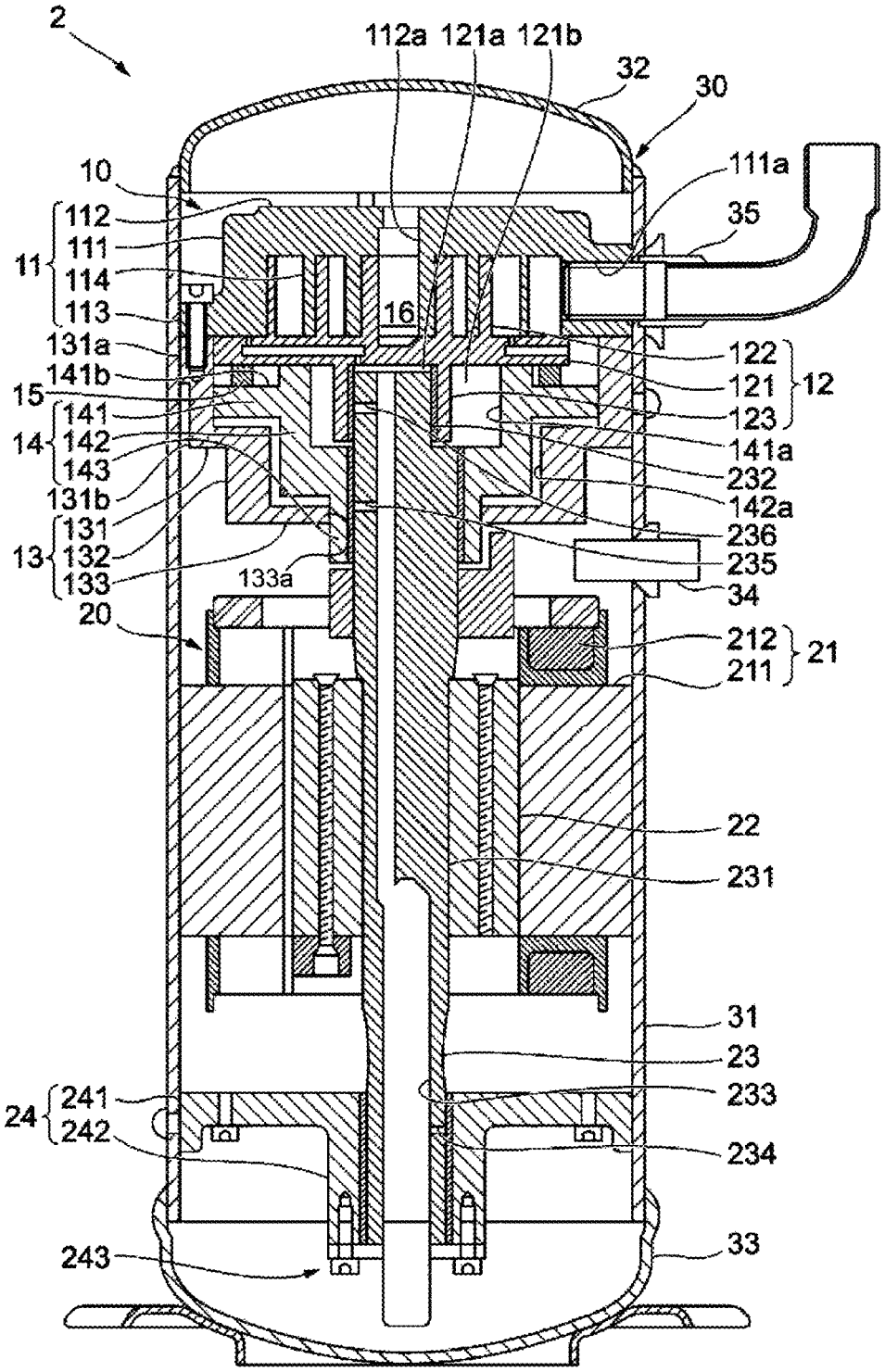
FIG. 6 illustrates an axial cross-sectional view of a scroll compressor according to an embodiment of the disclosure.

FIG. 6 illustrates an axial cross-sectional view of a scroll compressor according to an embodiment of the disclosure.

A scroll compressor 2 is a compressor widely used for an air conditioner, a freezer, and a heat pump. FIG. 6 illustrates a longitudinal sectional view of a hermetic scroll compressor used in a refrigerant circuit of an air conditioner.

The scroll compressor 2 includes a compression portion 10 configured to compress a refrigerant, a drive motor 20 configured to drive the compression portion 10, and a casing 30 corresponding to a body configured to receive the compression portion 10 and the drive motor 20. According to an embodiment, the scroll compressor 2 is a vertical scroll compressor in which an axial direction of a rotary shaft 23, which will be described later, of the drive motor 20 is coincident with the gravity direction. Hereinafter the axial direction of the rotary shaft 23 will be referred to as "vertical direction", and based on FIG. 6, the up side may be referred to as "upper side" and the down side may be referred to as "lower side". Although the vertical scroll compressor is described as an example, an embodiment of the disclosure will be applicable to a horizontal scroll compressor.

First, the compression portion 10 will be described.

The compression portion 10 may include a fixed scroll 11 fixed to the casing 30, an orbiting scroll 12 orbiting by being engaged with the fixed scroll 11, a main frame 13 fixed to the casing 30 and configured to support the fixed scroll 11, a sub frame 14 arranged between a rotary shaft 23 and the main frame 13 and configured to support the orbiting scroll 12, and an Oldham ring 15 configured to allow the orbiting scroll 12 to orbit without pivoting the orbiting scroll 12.

The fixed scroll 11 may include a fixed scroll body and a fixed wrap 114 protruding from the fixed scroll body. The fixed wrap 114 may protrude downward from the fixed scroll body.

The fixed scroll body may include a cylindrical body portion 111, a plate 112 configured to cover an opening in an upper side of the body portion 111, and a protrusion 113 extending from a lower end of the body portion 111 in radially outward direction. The fixed wrap 114 may protrude downward from a lower end of the plate 112 and have a spiral shape when viewed from the bottom.

The fixed scroll 11 may be formed of cast iron such as gray cast iron FC 250.

The body portion 111 may be provided with a through hole 111*a* in the radial direction. The though hole 111*a* may serve as a suction port configured to suction the refrigerant into a space surrounded by the body portion 111, the plate 112 and the orbiting scroll 12.

A through hole 112*a* in the vertical direction is formed at the center of the plate 112. The through hole 112*a* may serve as a discharge port configured to discharge the refrigerant from the space surrounded by the plate 112, the fixed wrap 114 and the orbiting scroll 12.

The fixed scroll 11 constructed as described above is fixed to the main frame 13 by a positioning means such as a bolt or a positioning pin passed through the through hole in the vertical direction formed in the protrusion 113.

The orbiting scroll 12 may include an orbiting scroll body and an orbiting wrap 122 protruding from the orbiting scroll body to form a compression chamber 16 by being engaged with the fixed wrap 114 of the fixed scroll 11. The orbiting wrap 122 may protrude upward from the orbiting scroll body.

The orbiting scroll body may include a plate 121 having a disk shape, and a cylindrical body portion 123 protruding downward from a lower end of the plate 121. The orbiting wrap 122 may protrude upward from an upper end of the plate 121 and have a spiral shape when viewed from the top.

The orbiting scroll 12 may be formed of FC material or FCD material.

The orbiting wrap 122 of the orbiting scroll 12 may be engaged with the fixed wrap 114 of the fixed scroll 11. Further, the orbiting wrap 122 of the orbiting scroll 12 and the fixed wrap 114 of the fixed scroll 11 may be placed in a space formed by the body portion 111 and the plate 112 of the fixed scroll 11 and the plate 121 so as to form the compression chamber 16. Because the orbiting wrap 122 is circularly moved about the fixed wrap 114 that is fixed, a volume of the compression chamber 16 is reduced and the refrigerant of the compression chamber 16 is compressed. In other words, as an internal space between the fixed wrap 114 and the orbiting wrap 122 is reduced toward a center of rotation, the refrigerant is compressed.

An eccentric shaft 232 of the rotary shaft 23, which is described later, is inserted into the body portion 123 through a sliding bearing. Therefore, the body portion 123 functions as a bearing of the eccentric shaft 232.

The main frame 13 is an example of a holding member configured to hold the fixed scroll 11. The main frame 13 may include a cylindrical first body portion 131, a cylindrical second body portion 132 protruding downward from the radially inner side of the lower end of the first body portion 131, and a cylindrical third body portion 133 protruding radially inwardly from the lower end of the second body portion 132. In the third body portion 133, a through hole 133*a* to which the rotary shaft 23 is inserted may be provided. An outer circumferential surface of the first body portion 131 of the main frame 13 is fixed to a central casing 31 of the casing 30, which is described later. The main frame 13 does not support the rotary shaft 23 of a drive motor 20, which is described later, according to an embodiment.

On an outer circumferential portion of the first body portion 131, a protrusion 131*a* protruding upward from the upper end surface is installed. A female screw is formed in the protrusion 131*a*, and a bolt, which passed through the through hole formed in the protrusion 113 of the fixed scroll 11, is engaged with the female screw. Therefore, the fixed scroll 11 is installed to the main frame 13.

On the outer circumferential portion of the first body portion 131, a groove 131*b* elongating in the vertical direction may be provided. That is, in the first body portion 131, the groove 131*b* extending in the vertical direction from the center to the lower portion of the outer circumferential portion may be formed. In the first body portion 131, a portion where the groove 131*b* is formed may be spaced apart from a central casing 31.

The main frame 13 may further include a fixed scroll support surface 11*a* configured to support the fixed scroll 11. The fixed scroll support surface 11*a* may be formed on the protrusion 131*a*.

The sub-frame 14 is an example of a support member for supporting the orbiting scroll 12. A gap may be formed between the main frame 13 and the sub frame 14 to allow the sub frame 14 to be movable about the main frame 13. In other words, the sub-frame 14 may be arranged inside the main frame 13 to be spaced apart from the main frame 13.

The sub-frame 14 may include a cylindrical first body portion 141, a cylindrical second body portion 142 protruding downward from a lower end surface of the first body portion 141, and a cylindrical third body portion 143 protruding downward from an inner end surface of the second body portion 142. The third body portion 143 may have a smaller width than the first body portion 141 and the second body portion 142. Particularly, a width of the inner circumferential surface of the third body portion 143 may be smaller than a width of an inner circumferential surface of the first body portion 141 and a width of an inner circumferential surface of the second body portion 142. The third body portion 143 may be inserted into the shaft through hole 133*a* to be positioned between the rotary shaft 23 and the third body portion 133 of the main frame 13. In addition, while a journal bearing is interposed therebetween, the rotary shaft 23 of the drive motor 20 described later is inserted into the inside of the third body portion 143. Therefore, the sub-frame 14 functions as a bearing for rotatably supporting the rotary shaft 23. The sub-frame 14 may be configured to be movable about the main frame 13 along at least one of the axial direction of the rotary shaft 23 and the direction perpendicular to the axial direction of the rotary shaft 23. In another aspect, between the outer circumferential surface of the first body portion 141 and the inner circumferential surface of the first body portion 131 of the main frame 13, and between the outer circumferential surface of the third body portion 143 and the inner circumferential surface of the third body portion 133 of the main frame 13, the sub-frame 14 may be arranged between the rotary shaft 23 and the main frame 13 with a gap allowing the sub-frame 14 to be movable in the axial direction of the rotary shaft 23 about the main frame 13 and to be movable in a rotational direction about a virtual axis approximately perpendicular to the rotary shaft 23.

In addition, in a portion formed by the first body portion 131 of the main frame 13 and the third body portion 143 of the sub-frame 14, and a portion formed by the first body portion 131 of the main frame 13 and the first body portion 141 of the sub-frame 14, a first groove 141*a* and a second groove 141*b* recessed downward from an upper end surface are formed. In the radial direction, the first groove 141*a* is formed in the center portion, and the second groove 141*b* is formed between the first groove 141*a* and the protrusion 131*a*. Further, the body portion 123 of the orbiting scroll 12 is inserted into the first groove 141*a*. In the second groove 141*b*, the Oldham ring 15 preventing a pivot of the orbiting scroll 12 is arranged between the main frame 13 and the orbiting scroll 12.

In addition, in the above-described compression portion 10, a discharge passage discharging refrigerant compressed in the compression chamber 16 is formed. As for the discharge passage configured to discharge the high-pressure refrigerant, one end thereof is connected to the through hole 112*a* of the plate 112, which is configured to discharge the high-pressure refrigerant from the space surrounded by the fixed scroll 11 and the orbiting scroll 12, and the other end thereof is connected to a space lower than the main frame 13 in the casing 30 and further connected to the chamber 121*a*. As for a discharge passage configured to discharge an intermediate pressure refrigerant, one end thereof is connected to a discharge port, which is configured to discharge a refrigerant from a space which has the intermediate-pressure refrigerant and is surrounded by the fixed scroll 11 and the orbiting scroll 12, and the other end thereof is connected to the chamber 121*b* and 142*a*.

Because the drive motor 20 and the casing 30 are the same as those previously described, a description thereof will be omitted.

Because the operation of the scroll compressor 2 is also the same as that previously described, a description thereof will be omitted.

On the other hand, in such a scroll compressor 2, the orbiting scroll 12 is about to incline due to a compressive load of the gas.

Figure 7A:
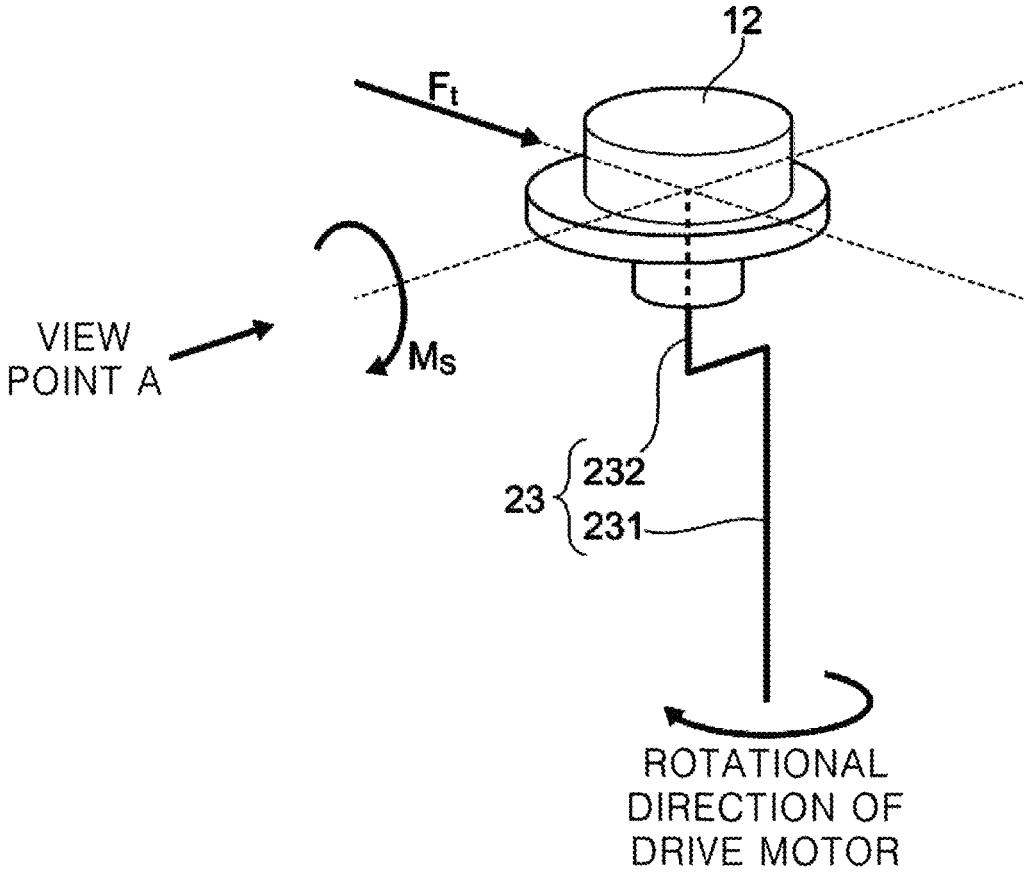
FIG. 7A is a perspective view illustrating a moment that an orbiting scroll receives.

FIG. 7A is a perspective view illustrating a moment that an orbiting scroll receives. As illustrated in FIG. 7A, the orbiting scroll 12 receives a compressive load $F_t$ from a direction orthogonal to an eccentric direction of the eccentric shaft 232 on a plane, from the main shaft 231 of the rotary shaft 23. Therefore, in the orbiting scroll 12, a clockwise moment $M_S$ as viewed from a viewpoint A is generated.

Figure 7B:
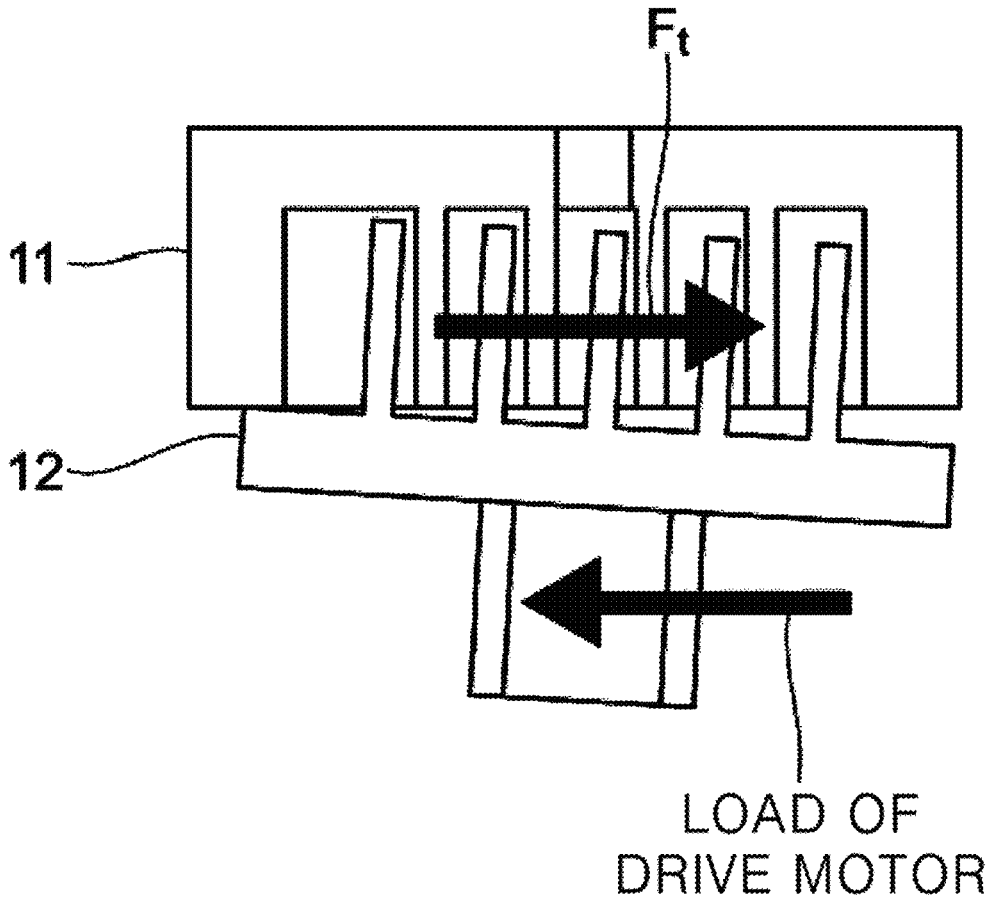
FIG. 7B is a view illustrating a shape in which the orbiting scroll is about to incline.

FIG. 7B is a view illustrating a shape in which the orbiting scroll is about to incline. Particularly, FIG. 7B is a view illustrating a case in which the orbiting scroll 12 is about to incline when viewed from the viewpoint A of FIG. 7A. As illustrated in FIG. 7B, the orbiting scroll 12 receives a compressive load $F_t$ and generates a clockwise moment load and thus the orbiting scroll is about to incline.

Meanwhile, the sub-frame 14 receives a lateral load from the shaft, and thus tries to move in the load direction.

Figure 8:
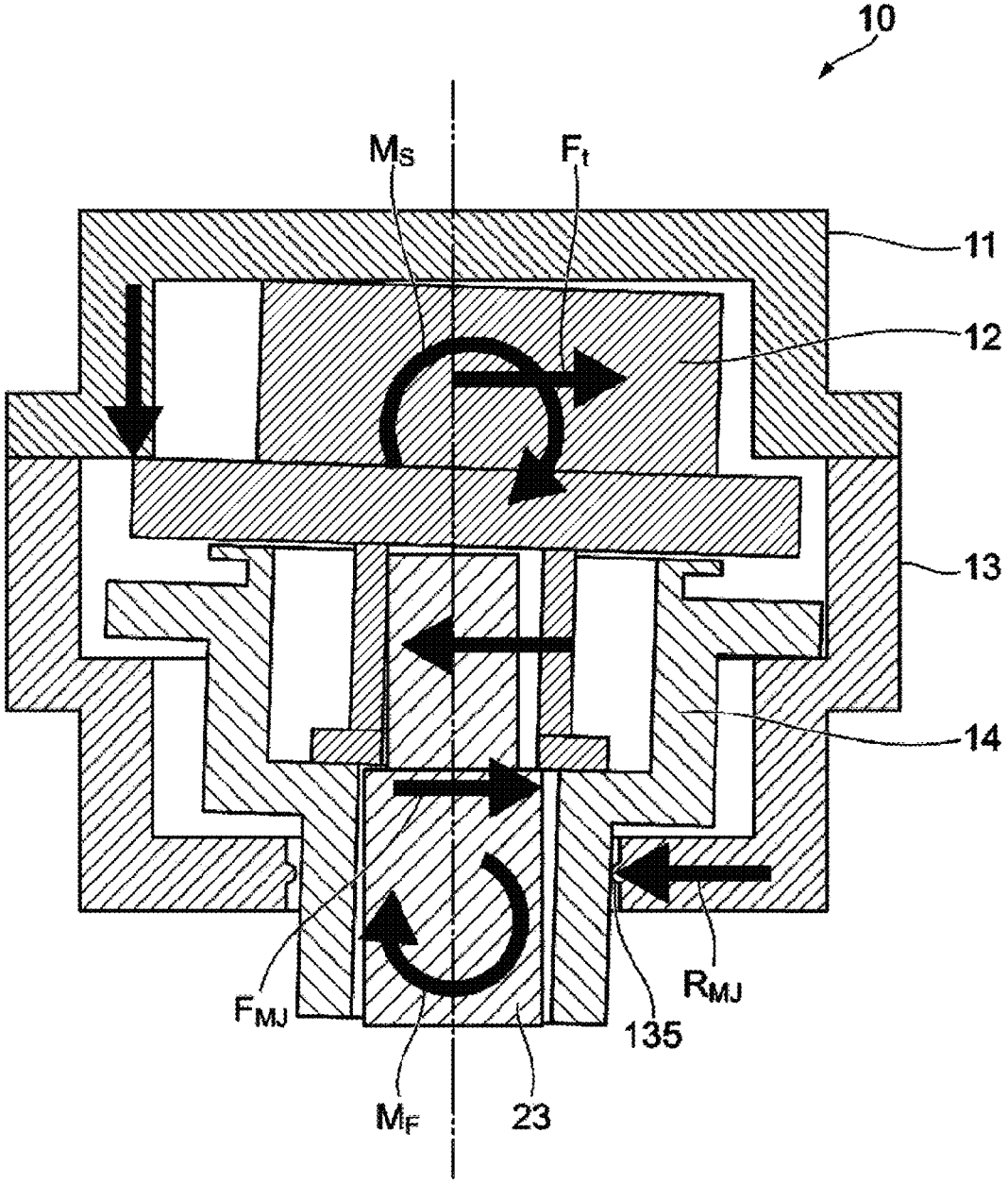
FIG. 8 illustrates an axial cross-sectional view of a compression portion and a rotary shaft when a moment applied to a sub frame is in the same direction as a moment applied to the orbiting scroll.

FIG. 8 illustrates an axial cross-sectional view of a compression portion and a rotary shaft when a moment applied to a sub frame is in the same direction as a moment applied to the orbiting scroll.

It is assumed that a position supporting a lateral load $F_{MJ}$ in the axis is opposite to the orbiting scroll 12 in relation to the lateral load $F_{MJ}$, as illustrated in FIG. 8. For example, it is assumed that a reaction force $R_{MJ}$ applied to the sub-frame 14 is generated in a position as illustrated in FIG. 8 as a protrusion 135 of the main frame 13 comes in contact with the sub-frame 14. Therefore, it is hard to effectively suppress an inclination of the orbiting scroll 12 because the moment $M_F$ applied to the sub-frame 14 and the moment $M_S$ applied to the orbiting scroll 12 are generated in the clockwise direction.

Therefore, according to an embodiment, it is possible to suppress the inclination of the orbiting scroll 12 by generating a moment in the direction opposite to the orbiting scroll 12, in the sub-frame 14 by using the lateral load. This is an example of allowing the sub-frame 14 to be movable in a direction opposite to the moment generated in the orbiting scroll 12 among rotational directions about a virtual axis approximately orthogonal to the rotary shaft 23.

Figure 9:
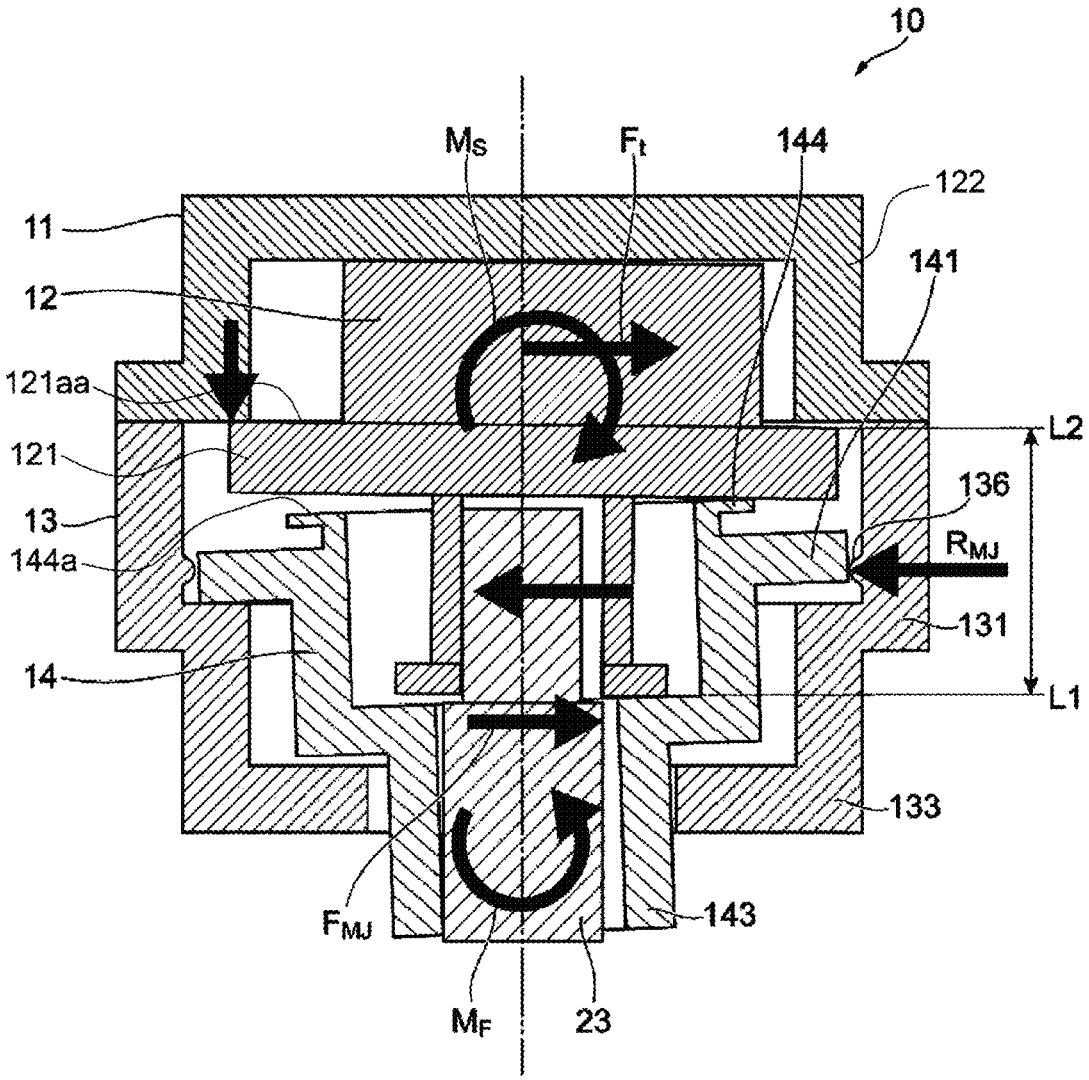
FIG. 9 illustrates an axial cross-sectional view of the compression portion and the rotary shaft when a moment applied to a sub frame is in an opposite direction to a moment applied to the orbiting scroll.

FIG. 9 illustrates an axial cross-sectional view of the compression portion and the rotary shaft when a moment applied to a sub frame is in an opposite direction to a moment applied to the orbiting scroll.

According to an embodiment, it is assumed that a position supporting a lateral load $F_{MJ}$ in the axis is in the same side as the orbiting scroll 12 in relation to the lateral load $F_{MJ}$, as illustrated in FIG. 9. For example, it is assumed that a reaction force $R_{MJ}$ applied to the sub-frame 14 is generated in a position as illustrated in FIG. 9 as a protrusion 136 formed in an inner circumferential surface of the main frame 13 comes in contact with the sub-frame 14.

Therefore, it is possible to effectively suppress the inclination of the orbiting scroll 12 because the moment $M_F$ applied to the sub-frame 14 is generated in the counterclockwise direction. This is an example in which a reaction force of the holding member against the load that the orbiting scroll receives is received on a predetermined position in the orbiting scroll side rather than a position receiving the load in the rotary shaft. A position in which the reaction force $R_{MJ}$ applied to the sub-frame 14 is generated may be between L1 and L2 as illustrated in FIG. 9. L1 is a position of an end surface the third body portion 143 of the sub-frame 14 in the orbiting scroll 12 side. When the end surface is inclined, it may be the lowest position of the end surface. L1 is an example of a position of an end surface of a rotary shaft bearing of the support member in the orbiting scroll side. In addition, L2 is a position of a surface on which the orbiting wrap 122 of the plate 121 of the orbiting scroll 12 is formed. In other words, the plate 121 of the orbiting scroll 12 may include an orbiting warp forming surface 121*a* a on which the orbiting wrap 122 is formed, and L2 is a position of the orbiting wrap forming surface 121*a* a. When this surface is inclined, it may be the uppermost position of the surface. L2 is an example of a position of a surface on which the plate of the orbiting scroll is engaged with the fixed scroll.

In addition, in order to generate the reaction force $R_{MJ}$ applied to the sub-frame 14 at the position shown in FIG. 9, when the orbiting scroll 12 is about to incline, the first body portion 131 of the main frame 13 and the first body portion 141 of the sub-frame 14 may be in contact before the third body portion 133 of the main frame 13 and the third body portion 143 of the sub-frame 14 are in contact. That is, when the sub-frame 14 is inclined upon the movement, the protrusion 136 of the main frame 13 and the first body portion 141 of the sub-frame 14 may be in contact before the third body portion 133 of the main frame 13 and the third body portion 143 of the sub-frame 14 are in contact. More particularly, when the thrust surface of the sub-frame 14 supporting the orbiting scroll 12 is approximately parallel with the thrust surface of the fixed scroll 11, the first body portion 131 of the main frame 13 and the first body portion 141 of the sub-frame 14 may be in contact before the third body portion 133 of the main frame 13 and the third body portion 143 of the sub-frame 14 are in contact.

To this end, a gap between the first body portion 131 of the main frame 13 and the first body portion 141 of the sub-frame 14 is less than a gap between the third body portion 133 of the main frame 13 and the third body portion 143 of the sub-frame 14. It is an example in which as for a position receiving a load about the rotary shaft, the smallest gap with the holding member in the same side as the orbiting scroll is less than the smallest gap with the holding member in the opposite side to the orbiting scroll. A position of the gap between the first body portion 131 of the main frame 13 and the first body portion 141 of the sub-frame 14 may be between L1 and L2 as illustrated in FIG. 9. L1 is a position of an end surface the third body portion 143 of the sub-frame 14 in the orbiting scroll 12 side. When the end surface is inclined, it may be the lowest position of the end surface. L1 is an example of a position of an end surface of a rotary shaft bearing of the support member in the orbiting scroll side. In addition, L2 is a position of a surface on which the orbiting wrap 122 of the plate 121 of the orbiting scroll 12 is formed. When this surface is inclined, it may be the uppermost position of the surface. L2 is an example of a position of a surface on which the plate of the orbiting scroll is engaged with the fixed scroll.

In addition, according to an embodiment, as illustrated in FIG. 9, the sub-frame 14 may include a thrust bearing 144 having an orbiting scroll support surface 144*a* supporting the orbiting scroll 12. The thrust bearing 144 may have an elastically deformable shape. Particularly, an outer circumferential side of the thrust bearing 144 of the sub-frame 14 may be inclined and thus when being in contact with one surface of the orbiting scroll 12, on which the orbiting scroll 12 is not formed, the thrust bearing 144 of the sub-frame 14 may be elastically deformed. In this way, the thrust load is distributed to suppress local contact. However, the shape of the thrust bearing 144 shown in FIG. 9 is not limited thereto, and thus the thrust bearing 144 may have a variety of shapes as long as being elastically deformed. The thrust bearing 144 is an example of a part of the support member for supporting the orbiting scroll, and the shape of the thrust bearing 144 of FIG. 9 is an example of a shape that is elastically deformed upon being in contact with a surface, on which the plate of the orbiting scroll is not engaged with the fixed scroll, due to the inclination of the orbiting scroll.

Next, an implementation of the Oldham ring 15 of the scroll compressor 2 according to an embodiment will be described.

Figure 10:
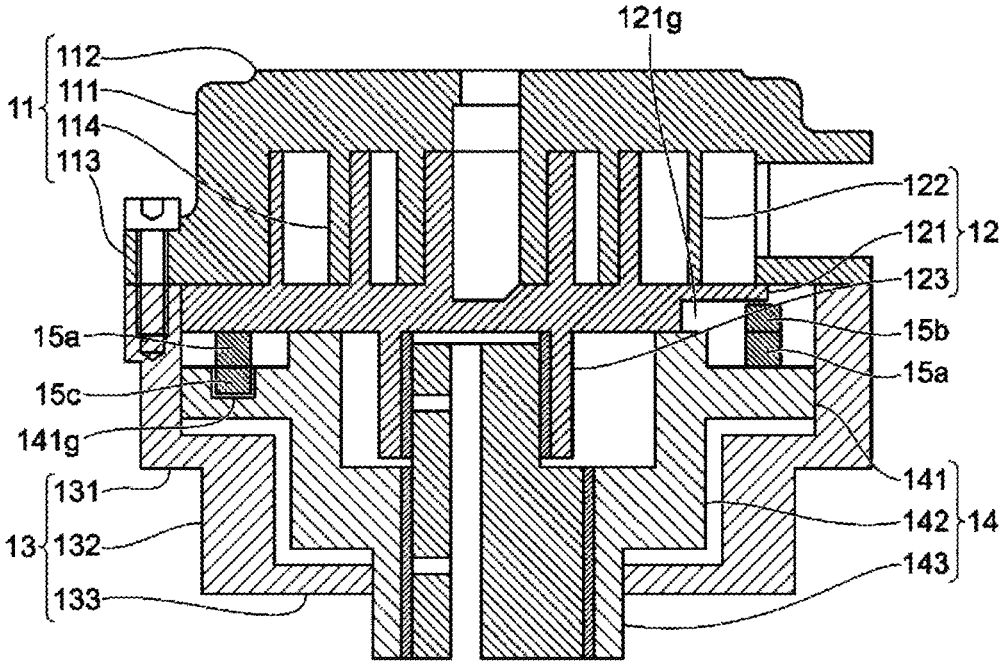
FIG. 10 illustrates an axial cross-sectional view of a compression portion and a rotary shaft according to an implementation of the scroll compressor.

FIG. 10 illustrates an axial cross-sectional view of a compression portion and a rotary shaft according to an implementation example of the scroll compressor.

A compression portion 10 according to an implementation of the scroll compressor 2 may include a fixed scroll 11, an orbiting scroll 12, a main frame 13, a sub-frame 14, and an Oldham ring 15 as illustrated in FIG. 1. In an implementation, the Oldham ring 15 is coupled to or engaged with the orbiting scroll 12 and the sub-frame 14. Particularly, one pair (two pieces) of Oldham ring guide grooves 121*g* are formed on a lower surface of the plate 121 of the orbiting scroll 12 in a substantially straight line. One pair (two pieces) of key portions 15*b* formed on an upper surface of a ring portion 15*a* of the Oldham ring 15 may be slidably coupled to or engaged with the Oldham ring guide grooves 121*g*. Further, one pair (two pieces) of Oldham ring guide grooves 141*g* having a phase difference of approximately 90° with the Oldham ring guide groove 121*g* of the orbiting scroll 12 are formed on an upper surface of the first body portion 141 of the sub-frame 14 in a substantially straight line. One pair (two pieces) of key portions 15*c* formed on a lower surface of the ring portion 15*a* of the Oldham ring 15 may be slidably coupled to or engaged with the Oldham ring guide grooves 141*g*. By the Oldham ring 15 configured as above mentioned, the orbiting scroll 12 may perform an orbital movement without pivoting.

Figure 11:
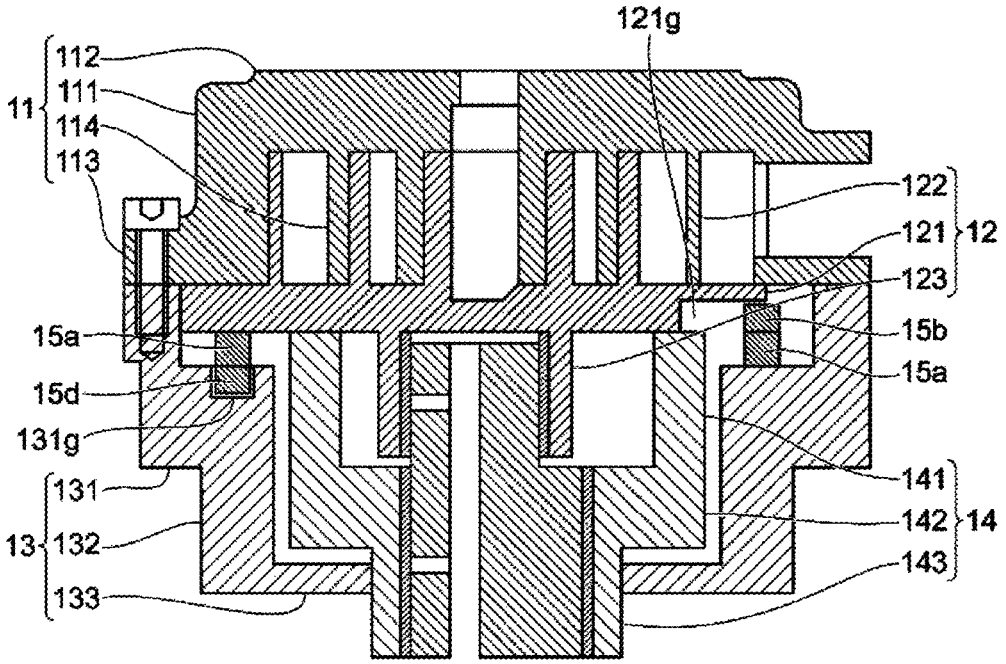
FIG. 11 illustrates an axial cross-sectional view of a compression portion and a rotary shaft according to an implementation of the scroll compressor.

FIG. 11 illustrates an axial cross-sectional view of a compression portion and a rotary shaft according to an implementation of the scroll compressor.

A compression portion 10 according to an implementation of the scroll compressor 2 may include a fixed scroll 11, an orbiting scroll 12, a main frame 13, a sub-frame 14, and an Oldham ring 15 as illustrated in FIG. 1. In an implementation, the Oldham ring 15 is coupled to or engaged with the orbiting scroll 12 and the sub-frame 14. Particularly, one pair (two pieces) of Oldham ring guide grooves 121*g* are formed on a lower surface of the plate 121 of the orbiting scroll 12 in a substantially straight line. One pair (two pieces) of key portions 15*b* formed on an upper surface of a ring portion 15*a* of the Oldham ring 15 may be slidably coupled to or engaged with the Oldham ring guide grooves 121*g*. Further, one pair (two pieces) of Oldham ring guide grooves 131*g* having a phase difference of approximately 90° with the Oldham ring guide groove 121*g* of the orbiting scroll 12 are formed on an upper surface of the first body portion 131 of the main frame 13 in a substantially straight line. One pair (two pieces) of key portions 15*d* formed on a lower surface of the ring portion 15*a* of the Oldham ring 15 may be slidably coupled to or engaged with the Oldham ring guide grooves 131*g*. By the Oldham ring 15 configured as above mentioned, the orbiting scroll 12 may perform an orbital movement without pivoting.

Figure 12:
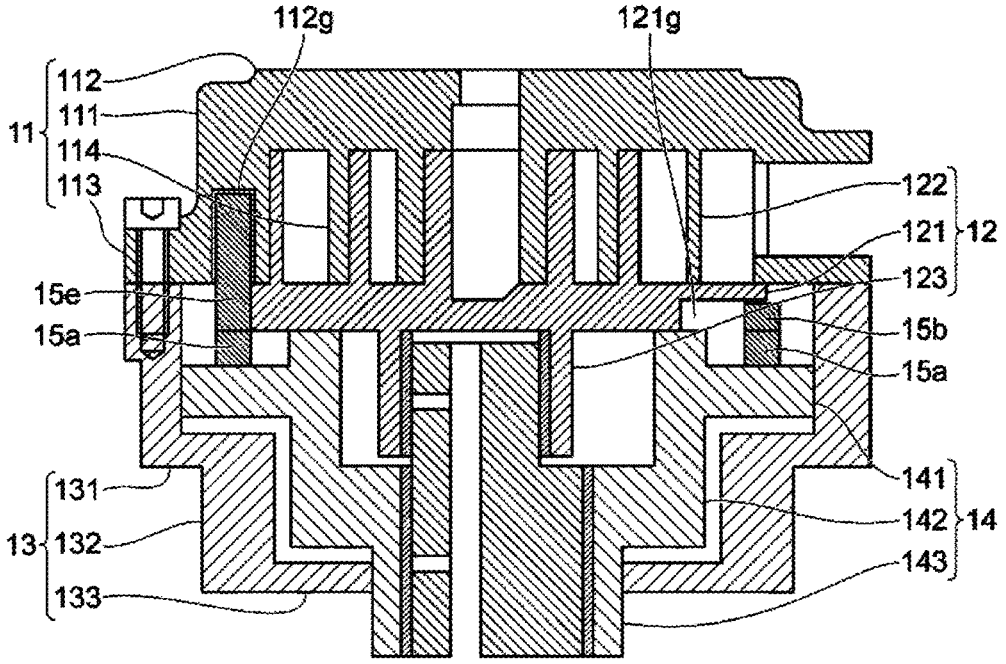
FIG. 12 illustrates an axial cross-sectional view of a compression portion and a rotary shaft according to an implementation example of the scroll compressor.

FIG. 12 illustrates an axial cross-sectional view of a compression portion and a rotary shaft according to an implementation of the scroll compressor.

A compression portion 10 according to an implementation of the scroll compressor 2 may include a fixed scroll 11, an orbiting scroll 12, a main frame 13, a sub-frame 14, and an Oldham ring 15 as illustrated in FIG. 1. In an implementation, the Oldham ring 15 is coupled to or engaged with the orbiting scroll 12 and the fixed scroll 11. Particularly, one pair (two pieces) of Oldham ring guide grooves 121*g* are formed on a lower surface of the plate 121 of the orbiting scroll 12 in a substantially straight line. One pair (two pieces) of key portions 15*b* formed on an upper surface of a ring portion 15*a* of the Oldham ring 15 may be slidably coupled to or engaged with the Oldham ring guide grooves 121*g*. Further, one pair (two pieces) of Oldham ring guide grooves 112*g* having a phase difference of approximately 90° with the Oldham ring guide groove 121*g* of the orbiting scroll 12 are formed on a lower surface of the plate 112 of the fixed scroll 11 in a substantially straight line. One pair (two pieces) of key portions 15*e* formed on an upper surface of the ring portion 15*a* of the Oldham ring 15 may be slidably coupled to or engaged with the Oldham ring guide grooves 112*g*. By the Oldham ring 15 configured as above mentioned, the orbiting scroll 12 may perform an orbital movement without pivoting.

However, in the configuration in which the sub-frame 14 supporting the orbiting scroll 12 is movable in only the direction along the rotary shaft 23, it is difficult to control the moment applied to the sub-frame 14 and thus just follow the trend. Therefore, it is difficult to effectively select the position of the lower thrust reaction force and thus the effect is not obtained. According to an embodiment, it is possible to effectively select the position of the lower thrust reaction force, thereby maximizing the effect.

In some embodiments, a space surrounded by the main frame 13 and the sub-frame 14 is formed by two sealing members between the main frame 13 and the sub-frame 14. The sub-frame 14 may be pushed against the orbiting scroll 12 by guiding a certain pressure (intermediate pressure) from the compression chamber 16 during the compression operation in this space. As for an implementation thereof, two methods may be mainly used, and it will be described in detail with some modifications.

Figure 13:
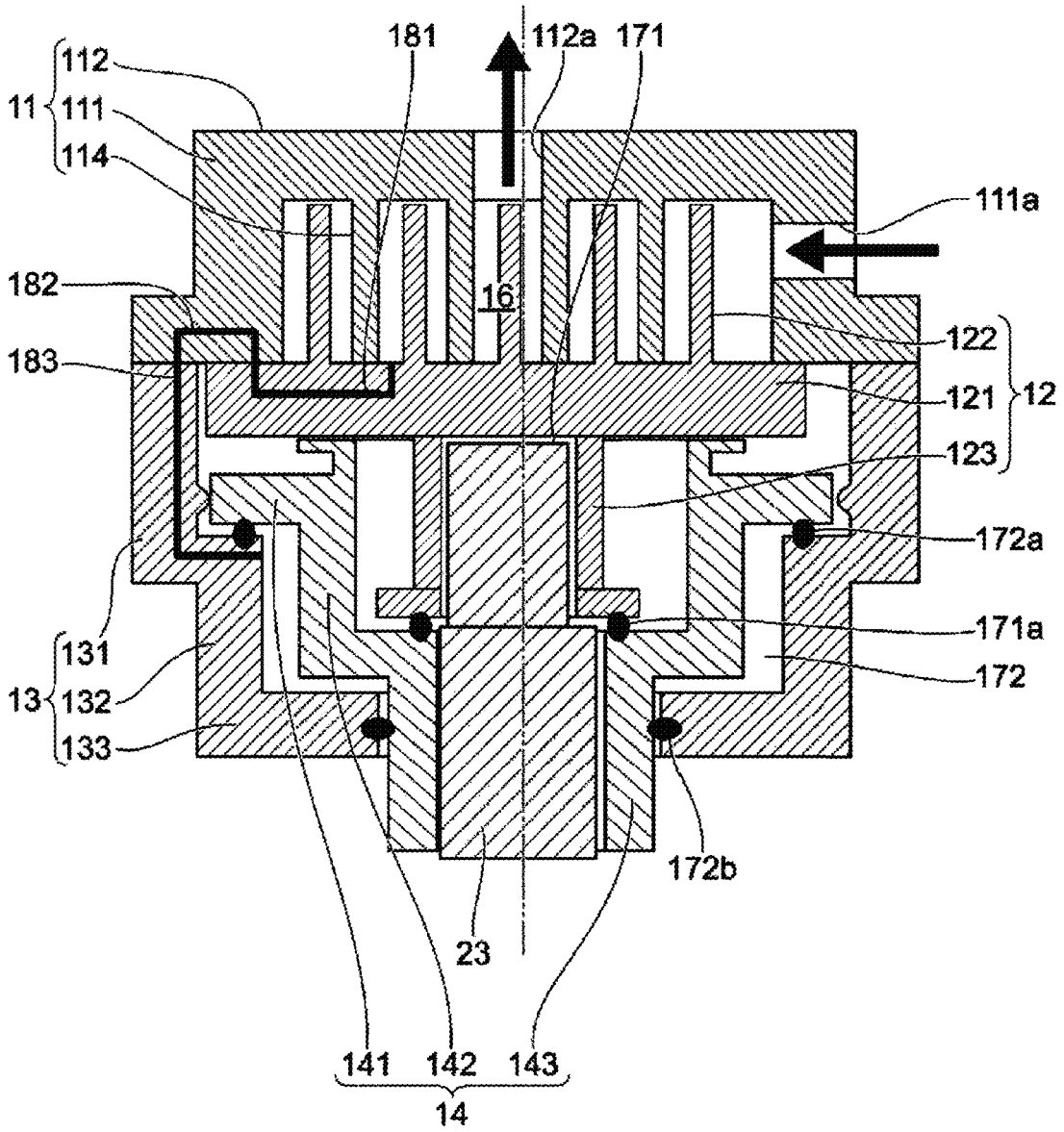
FIG. 13 illustrates an axial cross-sectional view of a compression portion and a rotary shaft of a modification of the scroll compressor according to an embodiment of the disclosure.

FIG. 13 illustrates an axial cross-sectional view of a compression portion and a rotary shaft of a modification of the scroll compressor according to an embodiment of the disclosure. In other words, FIG. 13 illustrates an axial cross-sectional view of the compression portion 10 and the rotary shaft 23 according to a modification of the scroll compressor 2.

A compression portion 10 according to a modification of the scroll compressor 2 may include a fixed scroll 11, an orbiting scroll 12, a main frame 13, and a sub-frame 14, as illustrated in FIG. 6. The orbiting scroll 12 orbits by being engaged with the fixed scroll 11 so as to form a compression chamber 16. The compression chamber 16 sucks and compresses a low pressure refrigerant as indicated by an arrow in a through hole 111*a* in the radial direction, and discharges a high pressure refrigerant as indicated by an arrow in a through hole 112*a* in a vertical direction. A description of the Oldham ring 15 will be omitted.

In the compression portion 10, a sealing member 171*a* configured to seal a gap between a body portion 123 of the orbiting scroll 12 and a third body portion 143 of the sub-frame 14 is provided. According to a modification, by providing the sealing member 171*a*, a chamber 171 is formed and the chamber 171 is maintained at a high pressure.

Further, sealing members 172*a* and 172*b* configured to seal a gap between the main frame 13 and the sub-frame 14 may be provided in the compression portion 10 so as to form a chamber 172 between the main frame 13 and the sub-frame 14. The sealing member 172*a* configured to seal a gap between a second body portion 132 of the main frame 13 and the first body portion 141 of the sub-frame 14 is provided, and at the same time, the sealing member 172*b* configured to seal a gap between a third body portion 133 of the main frame 13 and the third body portion 143 of the sub-frame 14 is provided. These sealing members 172*a* and 172*b* correspond to the two sealing members described above. According to a modification, the chamber 172 is formed by providing the sealing members 172*a* and 172*b*.

In addition, in the compression portion 10, passages 181, 182 and 183 configured to guide refrigerant discharged from the compression chamber 16 to the chamber 172 may be provided. Particularly, in the compression portion 10, the first passage 181, the second passage 182, and the third passage 183 configured to guide a refrigerant at a certain pressure from the compression chamber 16 to the chamber 172 are provided. The first passage 181 may be provided in the orbiting scroll 12 to communicate with the compression chamber 16. The first passage 181 is a passage passing through the inside of the orbiting scroll 12 and is an example of an internal passage of the orbiting scroll. The first passage 181 moves the refrigerant out of the compression chamber 16 and introduces the refrigerant into the second passage 182. The second passage 182 may be provided in the fixed scroll 11 to connect the first passage 181 to the third passage 183. The second passage 182 is a passage passing through the fixed scroll 11 and is an example of an internal passage of the fixed scroll. The second passage 182 moves the refrigerant introduced from the first passage 181 and introduces the refrigerant into the third passage 183. The third passage 183 may be provided in the main frame 13 to communicate with the chamber 172. The third passage 183 is a passage passing through the main frame 13 and is an example of an internal passage of the holding member. The third passage 183 moves the refrigerant introduced from the second passage 182 and introduces the refrigerant into the chamber 172. Accordingly, the pressure in the chamber 172 is maintained at a certain intermediate pressure.

Figure 14:
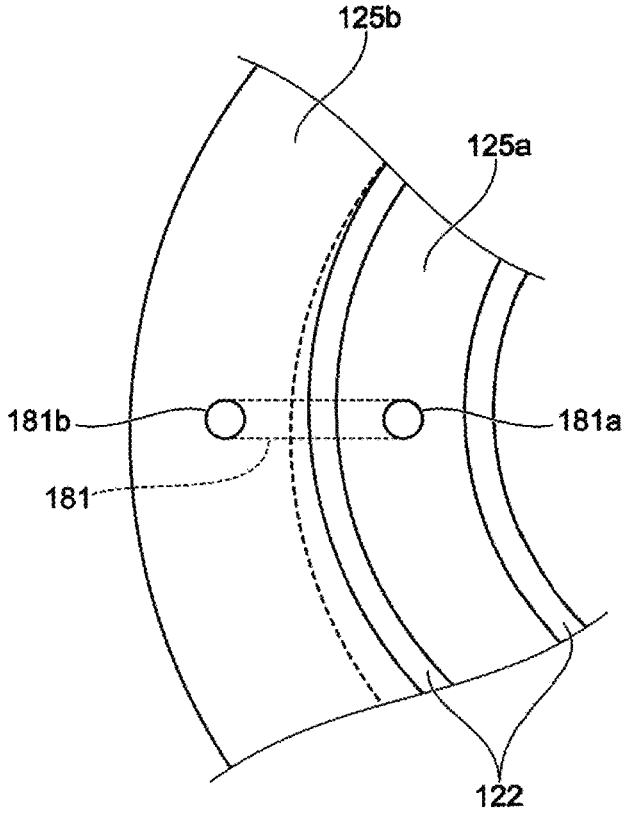
FIG. 14 is a top view illustrating an end portion of a plate of the orbiting scroll in the compression portion when viewed from the top, according to a modification of the scroll compressor according to an embodiment of the disclosure.

FIG. 14 is a top view illustrating an end portion of a plate of the orbiting scroll in the compression portion when viewed from the top, according to a modification of the scroll compressor according to an embodiment of the disclosure. In other words, FIG. 14 illustrates a plan view of the end portion of the plate 121 of the orbiting scroll 12 when viewed from the top.

Among the upper regions of the plate 121, an inlet 181*a* of the first passage 181 is provided in a region 125*a* (a region on the right side of a dotted line arc) facing the compression chamber 16, and an outlet 181*b* of the first passage 181 is provided in a region 125*b* (a region on the left side of the dotted line arc) being in contact with the body portion 111 of the fixed scroll 11. When the plate 121 is viewed from the top, the first passage 181 is not actually visible, but the first passage 181 is shown in dotted lines in the drawing for clarity. In addition, the inlet 181*a* of the first passage 181 is illustrated to be arranged in a region fitted in two orbiting wraps 122 which are the outmost and adjacent to each other, but the position of the inlet 181*a* is not limited thereto. Therefore, a position of the inlet 181*a* may be selected according to the magnitude of the intermediate pressure to be directed to the chamber 172. Therefore, the desired intermediate pressure refrigerant in the compression chamber 16 flows to the first passage 181.

Figure 15:
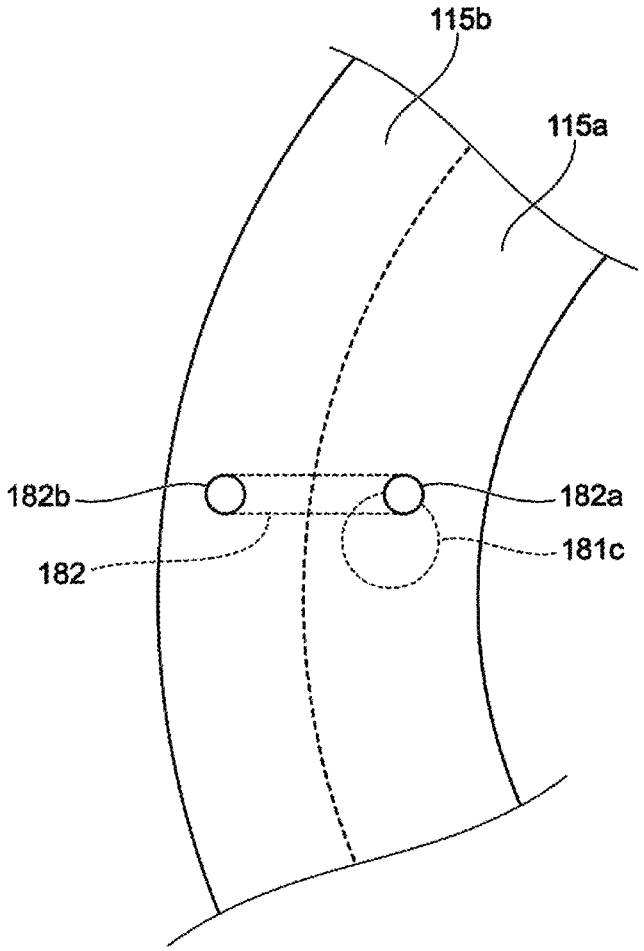
FIG. 15 is a bottom view illustrating a body portion of the fixed scroll in the compression portion when viewed from the bottom, according to a modification of the scroll compressor according to an embodiment of the disclosure.

FIG. 15 is a bottom view illustrating a body portion of the fixed scroll in the compression portion when viewed from the bottom, according to a modification of the scroll compressor according to an embodiment of the disclosure. In other words, FIG. 15 illustrates a bottom view of the body portion 111 of the fixed scroll 11 when viewed from the bottom.

Among the lower regions of the body portion 111, an inlet 182*a* of the second passage 182 is provided in a region 115*a* (a region on the right side of a dotted line arc) being in contact with the plate 121 of the orbiting scroll 12 and an outlet 182*b* of the second passage 182 is provided in a region 115*b* (a region on the left side of the dotted line arc) being in contact with the main frame 13. When the body portion 111 of the fixed scroll 11 is viewed from the bottom, the second passage 182 is not actually visible, but the second passage 182 is shown in dotted lines in the drawing for clarity. In addition, in a modification, the inlet 182*a* of the second passage 182 is provided in a point on a track 181*c* of the outlet 181*b* of the first passage 181 upon the orbit of the orbiting scroll 12. Therefore, a certain range of intermediate pressure refrigerant in the compression chamber 16 that the inlet 181*a* faces flows from the first passage 181 to the second passage 182.

Figure 16:
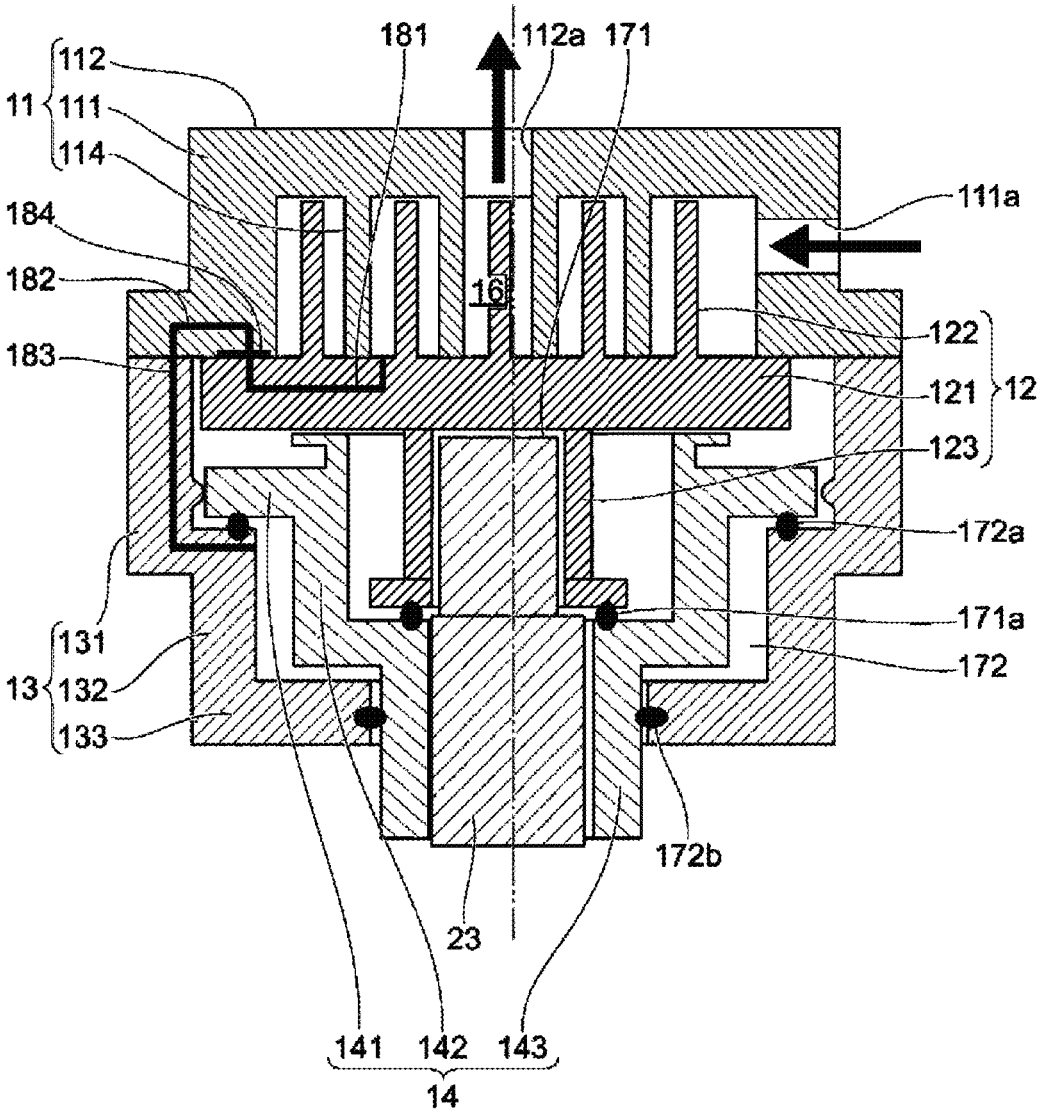
FIG. 16 illustrates an axial cross-sectional view of a compression portion and a rotary shaft of a modification of the scroll compressor according to an embodiment of the disclosure.

FIG. 16 illustrates an axial cross-sectional view of a compression portion and a rotary shaft of a modification of the scroll compressor according to an embodiment of the disclosure. In other words, FIG. 16 illustrates an axial cross-sectional view of the compression portion 10 and the rotary shaft 23 according to a modification of the scroll compressor 2.

A compression portion 10 according to a modification of the scroll compressor 2 may further include a counter bore 184, which is arranged between the first passage 181 and the second passage 182 in comparison with the compression portion 10 according to a modification of the scroll compressor 2 illustrated in FIG. 13.

Because the top view of the end portion of the plate 121 of the orbiting scroll 12 when viewed from the top has been previously described, a description thereof will be omitted.

Figure 17:
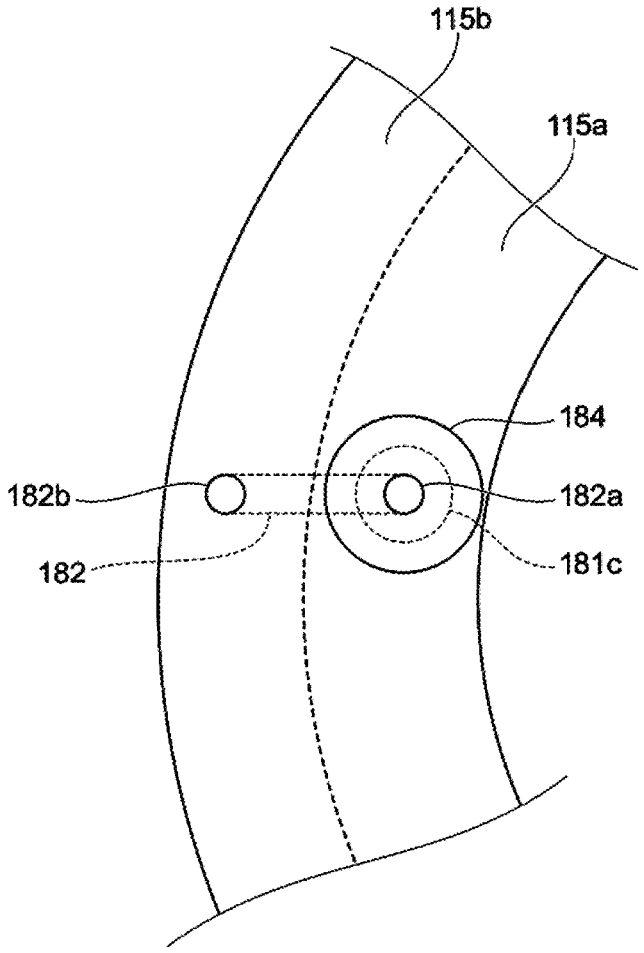
FIG. 17 is a bottom view illustrating a body portion of a fixed scroll in the compression portion when viewed from the bottom, according to a modification of the scroll compressor according to an embodiment of the disclosure.

FIG. 17 is a bottom view illustrating a body portion of a fixed scroll in the compression portion when viewed from the bottom, according to a modification of the scroll compressor according to an embodiment of the disclosure.

Among lower regions of a body portion 111, an inlet 182*a* of the second passage 182 is provided in a region 115*a* (a region on the right side of a dotted line arc) being in contact with the plate 121 of the orbiting scroll 12 and an outlet 182*b* of the second passage 182 is provided in a region 115*b* (a region on the left side of the dotted line arc) being in contact with the main frame 13. When the body portion 111 of the fixed scroll 11 is viewed from the bottom, the second passage 182 is not actually visible, but the second passage 182 is shown in dotted lines in the drawing for clarity. In addition, in a modification, the inlet 182*a* of the second passage 182 is provided to be in contact with the counter bore 184 corresponding to an example of a groove portion covering an entire of a track 181*c* of the outlet 181*b* of the first passage 181 upon the orbit of the orbiting scroll 12. Therefore, an intermediate pressure refrigerant in the compression chamber 16 that the inlet 181*a* faces flows from the first passage 181 to the second passage 182.

According to a modification, the inlet 182*a* of the second passage 182 is provided to be in contact with the counter bore 184 covering an entire of the track 181*c* of the outlet 181*b* of the first passage 181 upon the orbit of the orbiting scroll 12, but is not limited thereto. Alternatively, the inlet 182*a* of the second passage 182 is provided to be in contact with the counter bore 184 covering a part of of the track 181*c* of the outlet 181*b* of the first passage 181 upon the orbit of the orbiting scroll 12. That is, the inlet 182*a* of the second passage 182 may be in communication with the outlet 181*b* of the first passage 181 for at least a part of a cycle in which the orbiting scroll 12 orbits.

Further, according to some modifications, it is assumed that the first passage 181 configured to move the refrigerant out of the compression chamber 16 and introduce the refrigerant into the second passage 182 in the fixed scroll 11 is provided in the orbiting scroll 12, and the second passage 182 configured to introduce the refrigerant introduced from the first passage 181 in the orbiting scroll 12 to the third passage 183 in the main frame 13 is provided in the fixed scroll 11, but is not limited thereto. Alternatively, it may be assumed that a passage configured to move a refrigerant out of the compression chamber 16 and directly introduce the refrigerant into the third passage 183 of the main frame 13 is provided in the fixed scroll 11. By using the above mentioned configuration, a control of communication timing between the first passage 181 and the second passage 182 mentioned in some modifications may be not required.

In addition, according to some modifications, it is configured to introduce the intermediate pressure from the compression chamber 16 to the chamber 172 by forming the chamber 172 between the main frame 13 and the sub-frame 14 by sealing the gap between the main frame 13 and the sub-frame 14 by using the sealing member 172*a* and 172*b*, on the assumption of the shape of the main frame 13 and the sub-frame 14 as illustrated in FIGS. 6, 10 and 12, but is not limited thereto. For example, it may be configured to introduce the intermediate pressure from the compression chamber 16 to the chamber by forming the chamber between the main frame 13 and the sub-frame 14 by sealing the gap between the main frame 13 and the sub-frame 14 by using the two sealing members, on the assumption of the shape of the main frame 13 and the sub-frame 14 as illustrated in FIG. 11.

Alternatively, when it is assumed that the chamber 142*a* of FIGS. 2 to 4 corresponds to the chamber 172 of FIGS. 13 to 16 on the assumption of the shape of the main frame 13 and the sub-frame 14 according to an embodiment, the intermediate pressure may be introduced from the compression chamber 16 to the chamber 172. Further, when it is assumed that the space formed by the chamber 142*a* and the chamber 121*b* of FIG. 5 corresponds to the chamber 172 of FIGS. 13 to 16, the intermediate pressure may be introduced from the compression chamber 16 to the chamber 172.

In this sense, it should be understood that introducing the intermediate pressure from the compression chamber 16 to the chamber 172 by forming the chamber 172 between the main frame 13 and the sub-frame 14 by sealing the gap between the main frame 13 and the sub-frame 14 by using the sealing member 172*a* and 172*b* may include introducing the intermediate pressure from the compression chamber 16 to the chamber 172 by forming an inner space at least between the main frame 13 and the sub-frame 14 by sealing at least a gap between the main frame 13 and the sub-frame 14 by using the sealing mechanism.

As is apparent from the above description, it is possible to optimize the position where the load is applied to the orbiting scroll from the support member.

Although the present disclosure has been described with various embodiments, various changes and modifications may be suggested to one skilled in the art. It is intended that the present disclosure encompass such changes and modifications as fall within the scope of the appended claims.

What is claimed is:

1. A scroll compressor comprising:

a body;

a fixed scroll fixed to an inside of the body and provided with a fixed wrap;

an orbiting scroll configured to orbit about the fixed scroll and provided with an orbiting wrap forming a compression chamber together with the fixed wrap;

a main frame configured to support the fixed scroll;

a sub-frame arranged inside the main frame to support the orbiting scroll in a position away from a center of the orbiting scroll;

a gap formed between the main frame and the sub-frame to allow the sub-frame to be movable about the main frame;

a sealing member configured to seal at least a portion of the gap between the main frame and the sub-frame to form a chamber between the main frame and the sub-frame; and a passage configured to guide a refrigerant discharged from the compression chamber, wherein the passage comprises:

a first passage provided in the orbiting scroll to communicate with the compression chamber;

a second passage provided in the main frame to communicate with the chamber; and a third passage provided in the fixed scroll to connect the first passage to the second passage.

2. The scroll compressor of claim 1, wherein:

an outlet of the first passage forms a track according to an orbital movement of the orbiting scroll, and an inlet of the third passage is arranged on the track.

3. The scroll compressor of claim 1, further comprising:

a rotary shaft to which the orbiting scroll is coupled and by which the orbiting scroll orbits, wherein the sub-frame is configured to be movable about the main frame in at least one of a first direction extending along the rotary shaft or a second direction orthogonal to the first direction.

4. The scroll compressor of claim 1, further comprising:

a rotary shaft inserted into a shaft through hole formed in the main frame and coupled to the orbiting scroll to allow the orbiting scroll to orbit, wherein the main frame comprises a first body portion comprising a fixed scroll support surface configured to support the fixed scroll, and a second body portion positioned below the first body portion and comprising the shaft through hole, wherein the sub-frame comprises a first body portion arranged inside the first body portion of the main frame, and a second body portion inserted into the shaft through hole to be arranged between the rotary shaft and the second body portion of the main frame, and wherein a gap is formed between the first body portion of the main frame and the first body portion of the sub-frame and a gap is formed between the second body portion of the main frame and the second body portion of the sub-frame.

5. The scroll compressor of claim 4, wherein the gap between the first body portion of the main frame and the first body portion of the sub-frame is smaller than the gap between the second body portion of the main frame and the second body portion of the sub-frame.

6. The scroll compressor of claim 4, wherein the sub-frame is configured to be movable about the main frame, wherein the sub-frame further comprises a thrust bearing positioned above the first body portion of the sub-frame and comprising an orbiting scroll support surface configured to support the orbiting scroll, and wherein the thrust bearing has an elastically deformable shape.

7. The scroll compressor of claim 4, wherein the sub-frame is configured to be movable about the main frame, and a protrusion configured to be in contact with the first body portion of the sub-frame is formed on an inner surface of the first body portion of the main frame.

8. The scroll compressor of claim 7, wherein the protrusion of the main frame is in contact with the first body portion of the sub-frame before the second body portion of the main frame is in contact with the second body portion of the sub-frame when the sub-frame is inclined while being moved about the main frame.

9. The scroll compressor of claim 1, further comprising:

an Oldham ring configured to prevent a pivot of the orbiting scroll, wherein the Oldham ring is coupled to the orbiting scroll and the sub-frame.

10. The scroll compressor of claim 1, further comprising:

an Oldham ring configured to prevent a pivot of the orbiting scroll, wherein the Oldham ring is coupled to the orbiting scroll and the main frame.

11. The scroll compressor of claim 1, further comprising:

an Oldham ring configured to prevent a pivot of the orbiting scroll, wherein the Oldham ring is coupled to the orbiting scroll and the fixed scroll.

12. A scroll compressor comprising:

a body;

a fixed scroll fixed to an inside of the body and provided with a fixed wrap;

an orbiting scroll configured to orbit about the fixed scroll and provided with an orbiting wrap forming a compression chamber together with the fixed wrap;

a rotary shaft to which the orbiting scroll is coupled and by which the orbiting scroll orbits;

a main frame configured to support the fixed scroll;

a sub-frame arranged inside the main frame to be spaced apart from the main frame;

a gap formed between the main frame and the sub-frame to allow the sub-frame to be movable about the main frame;

a sealing member configured to seal at least a portion of the sap between the main frame and the sub-frame to form a chamber between the main frame and the sub-frame; and a passage configured to guide a refrigerant discharged from the compression chamber, wherein the passage comprises:

a first passage provided in the orbiting scroll to communicate with the compression chamber;

a second passage provided in the main frame to communicate with the chamber; and a third passage provided in the fixed scroll to connect the first passage to the second passage.

13. The scroll compressor of claim 12, wherein a gap between an upper end of the main frame and an upper end of the sub-frame positioned in an upper side in an axial direction of the rotary shaft is smaller than a gap between a lower end of the main frame and a lower end of the sub-frame positioned in a lower side in the axial direction of the rotary shaft.

14. The scroll compressor of claim 12, wherein:

the rotary shaft is inserted into a shaft through hole formed in the main frame and coupled to the orbiting scroll, the main frame comprises a first body portion comprising a fixed scroll support surface configured to support the fixed scroll, and a second body portion positioned below the first body portion and comprising the shaft through hole, the sub-frame comprises a first body portion arranged inside the first body portion of the main frame, and a second body portion inserted into the shaft through hole to be arranged between the rotary shaft and the second body portion of the main frame, and a gap between the first body portion of the main frame and the first body portion of the sub-frame is smaller than a gap between the second body portion of the main frame and the second body portion of the sub-frame.

15. The scroll compressor of claim 12, wherein:

the sub-frame is configured to be movable about the main frame, and a protrusion configured to be in contact with the sub-frame is formed on an inner surface of the main frame.

16. The scroll compressor of claim 15, wherein:

the orbiting scroll comprises a plate comprising an orbiting wrap forming surface on which the orbiting wrap is formed, the sub-frame comprises a first body portion facing the orbiting scroll, and a second body portion positioned below the first body portion to have a width smaller than that of the first body portion, and the protrusion is formed to protrude from the inner surface of the main frame to be arranged between the orbiting wrap forming surface and an upper end of the second body portion of the sub-frame in an axial direction of the rotary shaft.

* * * * *